US010103520B1

(12) United States Patent
Kobayashi

(10) Patent No.: US 10,103,520 B1
(45) Date of Patent: Oct. 16, 2018

(54) METHOD OF MANUFACTURING SPARK PLUG

(71) Applicant: NGK SPARK PLUG CO., LTD., Nagoya-shi, Aichi (JP)

(72) Inventor: Tsutomu Kobayashi, Inazawa (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/974,889

(22) Filed: May 9, 2018

(30) Foreign Application Priority Data

May 11, 2017 (JP) ..... 2017-094529

(51) Int. Cl.

| | |
|---|---|
| ***H01T 21/02*** | (2006.01) |
| ***H01T 13/58*** | (2011.01) |
| ***H01T 13/20*** | (2006.01) |
| *H01T 21/06* | (2006.01) |
| *F02P 17/12* | (2006.01) |

(52) U.S. Cl.
CPC ..... *H01T 21/02* (2013.01); *F02P 2017/121* (2013.01); *H01T 13/20* (2013.01); *H01T 13/58* (2013.01); *H01T 21/06* (2013.01)

(58) Field of Classification Search
CPC ..... H01T 21/00–21/06; H01T 13/20; H01T 13/58; F02P 2017/121
See application file for complete search history.

(56) References Cited

U.S. PATENT DOCUMENTS

2002/0102898 A1* 8/2002 Ito ..... H01T 21/02 445/4
2002/0142696 A1* 10/2002 Ito ..... H01T 21/02 445/3
2009/0017712 A1* 1/2009 Satoh ..... H01T 21/06 445/4
2009/0227168 A1* 9/2009 Nakamura ..... H01T 21/02 445/7
2014/0204198 A1* 7/2014 Fujita ..... H01T 21/02 348/86
2017/0025823 A1* 1/2017 Kimura ..... H01T 21/02

FOREIGN PATENT DOCUMENTS

EP 168543 A2 * 1/1986
JP 09-219273 A 8/1997

* cited by examiner

*Primary Examiner* — Mariceli Santiago
(74) *Attorney, Agent, or Firm* — Kusner & Jaffe

(57) ABSTRACT

A method of manufacturing a spark plug includes: mounting a metal shell on an assembly body of a temporary insulator and a temporary center electrode; causing discharge to occur between the temporary center electrode and the metal shell by applying a voltage across the metal shell and the temporary center electrode and capturing, while the discharge is occurring, an image of a range including the temporary center electrode, the temporary insulator, annular space which is present between the temporary insulator and the metal shell and has an opening on the front end side, and the metal shell; and determining whether or not the form of the inner circumferential surface of the metal shell is a predetermined form.

6 Claims, 12 Drawing Sheets

METHOD OF MANUFACTURING SPARK PLUG

RELATED APPLICATIONS

This application claims the benefit of Japanese Application No. 2017-094529 filed May 11, 2017, which is hereby fully incorporated herein by reference.

FIELD OF THE INVENTION

The present description relates to a technique for inspecting a metal shell for a spark plug.

BACKGROUND OF THE INVENTION

Spark plugs have been used for internal-combustion engines. For instance, a spark plug is utilized, which includes a cylindrical insulator having an axial bore extending in a direction of an axis, a metal shell disposed around an outer circumference of the insulator, and a center electrode disposed at the axial bore of the insulator.

A metal shell is manufactured by various processes such as forging and cutting. As a result of such manufacturing processes, the inner circumferential surface of the metal shell may take various forms. For instance, an unintended member (also called a foreign material) such as cutting chips may adhere to the inner circumferential surface of the metal shell. Such a foreign material can cause a defect. For instance, when a foreign material adheres to the inner circumferential surface of the metal shell, discharge may occur from the foreign material and not from an electrode.

The present description discloses a technique to appropriately determine whether or not the inner circumferential surface of a metal shell has a predetermined form.

SUMMARY OF THE INVENTION

The present description discloses the following application examples, for instance.

Application Example 1

In accordance with a first aspect of the present invention, there is provided a method of manufacturing a spark plug including:

a cylindrical insulator having an axial bore extending in a direction of an axis, a metal shell disposed around an outer circumference of the insulator, and a center electrode that is disposed in the axial bore of the insulator, and that has a front end portion projecting from a front end of the insulator, annular space having an opening on a front end side, being present between an outer circumferential surface of a front end portion of the insulator and an inner circumferential surface of the metal shell, the method comprising:

mounting the metal shell on an assembly body of a temporary insulator with a front end portion having a same shape as a shape of at least the front end portion of the insulator, and a temporary center electrode with a front end portion having a same shape as a shape of at least the front end portion of the center electrode;

causing discharge to occur between the temporary center electrode and the metal shell by applying a voltage across the metal shell and the temporary center electrode under an atmosphere of a predetermined pressure condition, and capturing, while the discharge is occurring, an image of a range including the temporary center electrode, the temporary insulator, annular space which is present between the temporary insulator and the metal shell and has an opening on the front end side, and the metal shell from the front end side in the direction of the axis;

determining whether or not a form of the inner circumferential surface of the metal shell is a predetermined form by analyzing the image obtained in the capturing; and assembling the spark plug using the metal shell, when the form of the inner circumferential surface of the metal shell is determined to be the predetermined form.

With this configuration, the image analyzed to determine whether or not the form of the inner circumferential surface of the metal shell is a predetermined form is an image captured from the front end side in the direction of the axis, while discharge is occurring between the temporary center electrode and the metal shell, and is an image of a range including the temporary center electrode, the temporary insulator, the annular space having an opening on the front end side, present between the temporary insulator and the metal shell, and the metal shell. Thus, whether or not the inner circumferential surface of the metal shell has a predetermined form can be appropriately determined.

Application Example 2

In accordance with a second aspect of the present invention, there is provided a method of manufacturing a spark plug according to Application Example 1, wherein in the assembling, the spark plug is assembled by using the temporary insulator and the temporary center electrode as the insulator and the center electrode.

With this configuration, when that the form of the inner circumferential surface of the metal shell is determined to be a predetermined form, the temporary insulator and the temporary center electrode are used as the insulator and the center electrode, and thus change in the form of the inner circumferential surface of the metal shell from a predetermined form to another form due to removal of the temporary insulator or the temporary center electrode is avoided. Consequently, when it is determined in the determining that the form of the inner circumferential surface of the metal shell is a predetermined form, a spark plug can be manufactured using the metal shell in an appropriate form.

Application Example 3

In accordance with a third aspect of the present invention, there is provided a method of manufacturing a spark plug according to Application Example 1 or 2, wherein the spark plug includes a ground electrode that is connected to the metal shell and faces the center electrode, and in the capturing, the discharge is caused to occur before the ground electrode is disposed at a position facing the temporary center electrode.

With this configuration, discharge and image capturing in the image capturing are performed with reduced discharge between the ground electrode and the center electrode, and thus it is possible to obtain an appropriate image for determining whether or not the form of the inner circumferential surface of the metal shell is a predetermined form. Consequently, whether or not the inner circumferential surface of the metal shell has a predetermined form can be appropriately determined.

Application Example 4

In accordance with a fourth aspect of the present invention, there is provided a method of manufacturing a spark plug according to any one of Application Examples 1 to 3, wherein the metal shell includes a projection portion that projects inwardly in a radial direction, the temporary insulator is directly or indirectly supported by the projection portion from the front end side, and the determining includes determining whether or not the discharge crosses an area indicating a gap between the temporary insulator and the projection portion of the metal shell on the image.

With this configuration, on the image obtained in the image capturing, it is possible to distinguish a state where a foreign material, which overlaps with the area between the temporary insulator and the projection portion of the metal shell, adheres to the inner circumferential surface of the metal shell from a state where such a foreign material does not adhere to the inner circumferential surface of the metal shell. Thus, whether or not the inner circumferential surface of the metal shell has a predetermined form can be appropriately determined.

Application Example 5

In accordance with a fifth aspect of the present invention, there is provided a method of manufacturing a spark plug according to any one of Application Examples 1 to 4, wherein the capturing is performed N times (N is an integer greater than or equal to 2), and the determining includes determining whether or not an uneven condition is satisfied, the uneven condition indicating that positions of discharge in a circumferential direction around the axis at a center in N images obtained in the capturing are unevenly located in a partial range in the circumferential direction.

With this configuration, it is possible to distinguish a state where a foreign material adheres to the inner circumferential surface of the metal shell from a state where such a foreign material does not adhere to the inner circumferential surface of the metal shell, and thus, whether or not the inner circumferential surface of the metal shell has a predetermined form can be appropriately determined.

Application Example 6

In accordance with a sixth aspect of the present invention, there is provided a method of manufacturing a spark plug according to Application Example 5, wherein the determining includes:

identifying K (K is an integer greater than or equal to 2) partial areas radially equiangularly divided around the axis at the center for each of the N images;

identifying K same-direction partial area groups, each of which is a same-direction partial area group including N partial areas positioned in a same orientation with reference to the axis and which have different orientations with reference to the axis, by using N×K partial areas obtained from the N images; and calculating, for each of the same-direction partial area groups, a ratio of a number of images indicating discharge crossing the partial areas included in the same-direction partial area group to the total N images, and the uneven condition is that a total of L ratios each of which is the ratio of circumferentially contiguous L ($1 \leq L < K$) same-direction partial area groups with a center at the same-direction partial area group having the ratio of a highest exceeds a threshold value greater than a total of the L ratios of the L same-direction partial area groups when N discharge occurrences are evenly distributed in the circumferential direction.

With this configuration, it is possible to distinguish a state where the positions of discharge in the circumferential direction are unevenly located in a partial range in the circumferential direction from another state, and thus whether or not the inner circumferential surface of the metal shell has a predetermined form can be appropriately determined.

It is to be noted that the technique disclosed in the present descriptions can be implemented in various embodiments, and such embodiments, for instance, a method of inspecting the inner circumferential surface of a metal member, a method of manufacturing a metal shell, a method of manufacturing a spark plug including a metal shell, a spark plug manufactured by the manufacturing method, a computer program for implementing those methods, and a recording medium in which the computer program is recorded (for instance, a non-volatile recording medium).

DETAILED DESCRIPTION OF THE INVENTION

A. First Embodiment

A-1. Configuration of Spark Plug 100

Figure 1:
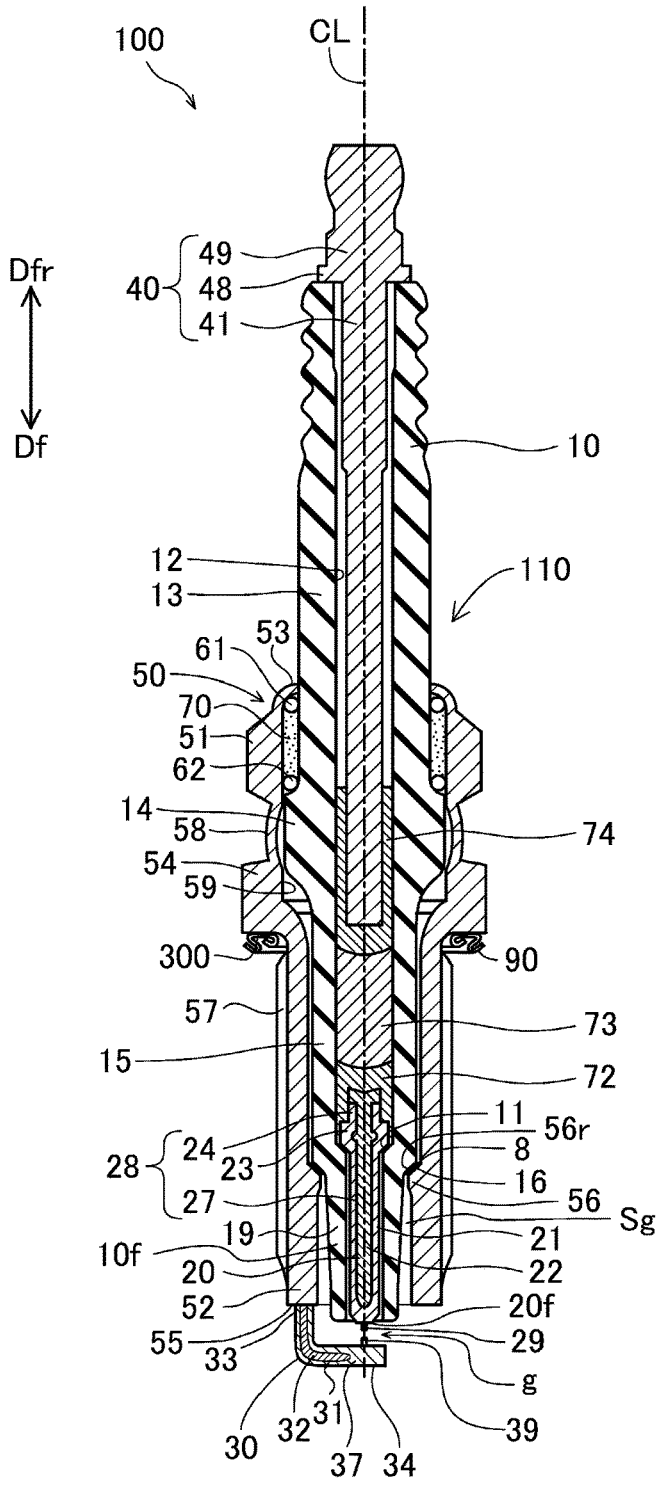
FIG. 1 is a sectional view of a spark plug as an embodiment.

FIG. 1 is a sectional view of a spark plug 100 as an embodiment. FIG. 1 illustrates a central axis CL (also called an "axis CL") of the spark plug 100, and a flat cross section including the central axis CL of the spark plug 100. Hereinafter, a direction parallel to the central axis CL is called a "direction of the axis CL", or simply an "axis direction" or a "fore-and-aft direction". A radial direction of a circle with the center on the axis CL is also called a "radial direction". The radial direction is a direction perpendicular to the axis CL. A circumference direction of a circle with the center on the axis CL is also called a "circumferential direction". Between directions parallel to the central axis CL, the downward direction in FIG. 1 is called the front end direction Df or the front direction Df, and the upward direction in FIG. 1 is called the rear end direction Dfr or the rear direction Dfr. The front end direction Df is the direction toward the center electrode 20 from the later-described metal terminal 40. Also, the side in the front end direction Df in FIG. 1 is called the front end side of the spark plug 100, and the side in the rear end direction Dfr in FIG. 1 is called the rear end side of the spark plug 100.

The spark plug 100 has a cylindrical insulator 10 having a through hole 12 (also called an axial bore 12) extending along the axis CL; a center electrode 20 held by the front end side of the through hole 12; a metal terminal 40 held on the rear end side of the through hole 12; a resistive element 73 disposed between the center electrode 20 and the metal terminal 40 in the through hole 12; a conductive first seal portion 72 that is in contact with the center electrode 20 and the resistive element 73 to electrically connect these members 20, 73; a conductive second seal portion 74 that is in contact with the resistive element 73 and the metal terminal 40 to electrically connect these members 73, 40; a cylindrical metal shell 50 fixed to the outer circumferential side of the insulator 10; and a ground electrode 30 having one end bonded to a front end face 55 of the metal shell 50 and the other end disposed to face the center electrode 20 with a gap g between the other end and the center electrode 20.

A large diameter portion 14 having a largest outer diameter is formed at substantially the center of the insulator 10 in the axis direction. A rear end trunk portion 13 is formed on the rear end side of the large diameter portion 14. A front end trunk portion 15 having a diameter smaller than the diameter of the rear end trunk portion 13 is formed on the front end side of the large diameter portion 14. On the further front end side from the front end trunk portion 15, an outer diameter reduction portion 16, and a leg portion 19 are formed toward the front end side in that order. The outer diameter of the outer diameter reduction portion 16 is gradually reduced in the front direction Df. In the vicinity (the front end trunk portion 15 in the example of FIG. 1) of the outer diameter reduction portion 16, an inner diameter reduction portion 11 having an inner diameter gradually reduced in the front direction Df is formed. The insulator 10 is preferably formed in consideration of mechanical strength, thermal strength, and electrical strength. The insulator 10 is formed by calcining alumina, for instance (another insulating material may also be used).

The center electrode 20 is a metal member, and is disposed at the end on the front direction Df side in the through hole 12 of the insulator 10. The center electrode 20 has a substantially cylindrical rod portion 28, and a first tip 29 bonded (for instance, laser welded) to the front end of the rod portion 28. The rod portion 28 has a head portion 24 which is a portion on the rear direction Dfr side, and an axial portion 27 connected to the head portion 24 on the front direction Df side. The axial portion 27 extends in the front direction Df in parallel to the axis CL. A flange portion 23 having an outer diameter larger than the outer diameter of the axial portion 27 is formed at a portion of the head portion 24 on the front direction Df side. The surface, on the front direction Df side, of the flange portion 23 is supported by the inner diameter reduction portion 11 of the insulator 10. The axial portion 27 is connected to the flange portion 23 on the front direction Df side. The first tip 29 is bonded to the front end of the axial portion 27.

The rod portion 28 has an outer layer 21 and core portion 22 disposed on the inner circumferential side of the outer layer 21. The outer layer 21 is composed of a material (for instance, an alloy containing nickel as the main component) having oxidation resistance superior to the oxidation resistance of the core portion 22. Here, the main component refers to a component with the highest content ratio (mass percentage (wt %)). The core portion 22 is composed of a material (for instance, an alloy containing pure copper, copper as the main component) having a thermal conductivity higher than the thermal conductivity of the outer layer 21. The first tip 29 is composed using a material (for instance, precious metal such as iridium (Ir), platinum (Pt)) having durability against discharge superior to that of the axial portion 27. A front end portion **20*f* which is a portion, of the center electrode 20, in the front end side including the first tip 29 is exposed to the side in the front direction Df from the axial bore 12 of the insulator 10. It is to be noted that the core portion 22 may be omitted. Also, the first tip 29** may be omitted.

A metal terminal 40 is a rod-like member extending parallel to the axis CL. The metal terminal 40 is composed using a conductive material (for instance, metal containing steel as the main component). The metal terminal 40 has a cap mounting portion 49, a flange portion 48, and an axial portion 41 arranged sequentially in the front direction Df. The axial portion 41 is inserted in a portion, on the rear direction Dfr side, of the axial bore 12 of the insulator 10. The cap mounting portion 49 is exposed to the outside of the axial bore 12 on the rear end side of the insulator 10.

The resistive element 73 for reducing electrical noise is disposed between the metal terminal 40 and the center electrodes 20 in the axial bore 12 of the insulator 10. The resistive element 73 is composed using a conductive material (for instance, a mixture of glass, carbon particles, and ceramic particles). The first seal portion 72 is disposed between the resistive element 73 and the center electrodes 20, and the second seal portion 74 is disposed between the resistive element 73 and the metal terminal 40. These seal portions 72 and 74 are composed using a conductive material (for instance, a mixture of metal particles and the same glass contained in the material of the resistive element 73). The center electrode 20 is electrically connected to the metal terminal 40 by the first seal portion 72, the resistive element 73, and the second seal portion 74.

The metal shell 50 is a cylindrical member having a through hole 59 extending along the axis CL. The insulator 10 is inserted in the through hole 59 of the metal shell 50, and the metal shell 50 is fixed to the outer circumference of the insulator 10. The metal shell 50 is composed using a conductive material (for instance, metal such as carbon steel containing steel which is the main component). Part of the insulator 10 on the front direction Df side is exposed to the outside of the through hole 59. Also, part of the insulator 10 on the rear direction Dfr side is exposed to the outside of the through hole 59.

The metal shell 50 has a tool engagement portion 51, and a front end trunk portion 52. The tool engagement portion 51 is a portion to which a wrench (not illustrated) for a spark plug is fitted. The front end trunk portion 52 is a portion that includes the front end face 55 of the metal shell 50. A screw portion 57 to be screwed in a mounting hole for an internal-combustion engine (for instance, a gasoline engine) is formed on the outer circumferential surface of the front end trunk portion 52. The screw portion 57 is a portion in which a male screw extending in the direction of the axis CL is formed.

A flange-shaped middle trunk portion 54 projecting outwardly in the radial direction is formed on the outer circumferential surface between the tool engagement portion 51 and the front end trunk portion 52 of the metal shell 50.

The outer diameter of the middle trunk portion 54 is larger than the maximum outer diameter (in other words, the outer diameter of the top of the screw thread) of the screw portion 57. A surface 300, on the front direction Df side, of the middle trunk portion 54 is a seat surface, and forms a seal (called a seat surface 300) with a mounting portion (for instance, an engine head), which is a portion forming a mounting hole, of the internal-combustion engine.

An annular gasket 90 is disposed between the screw portion 57 of the front end trunk portion 52 and the seat surface 300 of the medium trunk portion 54. When the spark plug 100 is mounted in an internal-combustion engine, the gasket 90 is crushed and deformed to seal the gap between the seat surface 300 of the metal shell 50 and the mounting portion (for instance, the engine head) of the internal-combustion engine, which is not illustrated. It is to be noted that the gasket 90 may be omitted. In this case, the seat surface 300 of the metal shell 50 comes into direct contact with the mounting portion of the internal-combustion engine, thereby sealing the gap between the seat surface 300 and the mounting portion of the internal-combustion engine.

A projection portion 56 projecting inwardly in the radial direction is formed at the front end trunk portion 52 of the metal shell 50. The projection portion 56 is a portion with an internal diameter smaller than the at least internal diameter of a portion, on the rear direction Dfr side, of the projection portion 56. In this embodiment, the internal diameter is gradually reduced in the front direction Df on a surface **56*r* (also called a rear surface 56*r*), on the rear direction Dfr side, of the projection portion 56. A front end-side packing 8 is inserted between the rear surface 56*r* of the projection portion 56 and the outer diameter reduction portion 16 of the insulator 10. In this embodiment, the front end-side packing 8 is, for instance, a plate-shaped iron ring (other materials (for instance, a metal material such as copper) may also be used). The projection portion 56 indirectly supports the outer diameter reduction portion 16 of the insulator 10 from the front direction Df side via the packing 8. It is to be noted that the packing 8 may be omitted. In this case, the projection portion 56 (specifically, the rear surface 56*r* of the projection portion 56) may be in contact with the outer diameter reduction portion 16 of the insulator 10. In other words, the projection portion 56 may directly support the insulator 10**.

A rear end portion 53, which forms the rear end of the metal shell 50 and is a thin-walled portion thinner than the tool engagement portion 51, is formed on the rear end side from the tool engagement portion 51 of the metal shell 50. Also, a connection portion 58, which connects the middle trunk portion 54 and the tool engagement portions 51, is formed between the middle trunk portion 54 and the tool engagement portions 51. The connection portion 58 is a thin-walled portion thinner than the middle trunk portion 54 and the tool engagement portions 51. Annular ring members 61, 62 are inserted between the inner circumferential surface of the area from the tool engagement portion 51 of the metal shell 50 to the rear end portion 53, and the outer circumferential surface of the rear end trunk portion 13 of the insulator 10. Furthermore, powder of talc 70 is filled between these ring members 61 and 62. In the manufacturing process of the spark plug 100, when the rear end portion 53 is inwardly bent and swaged, the connection portion 58 is outwardly deformed (for instance, buckled) in association with application of a compressive force, and consequently, the metal shell 50 and the insulator 10 are fixed. In the swaging process, the talc 70 is compressed, and the air-tightness between the metal shell 50 and insulator 10 is improved. Also, the packing 8 is pressed between the outer diameter reduction portion 16 of the insulator 10 and the projection portion 56 of the metal shell 50, and seals between the metal shell 50 and the insulator 10.

The ground electrode 30 is a metal member, and has a rod-like main body 37, and a second tip 39 attached to the front end portion 34 of the main body 37. The other end 33 (also called the base end 33) of the main body 37 is bonded (for instance, resistance welded) to the front end face 55 of the metal shell 50. The main body 37 extends in the front end direction Df from the base end 33 bonded to the metal shell 50, bends toward the central axis CL, and reaches the front end portion 34. The second tip 39 is fixed (for instance, resistance welded or laser welded) to a portion, on the rear direction Dfr side, of the front end portion 34. The main body 37 corresponds to the base to which the tip 39 is bonded. The second tip 39 of the ground electrode 30 and the first tip 29 of the center electrode 20 form the gap g. That is, the second tip 39 of the ground electrode 30 is disposed on the front direction Df side of the first tip 29 of the center electrode 20, and faces the first tip 29 with the gap g between the second tip 39 and the first tip 29. The second tip 39 is composed using a material (for instance, precious metal such as iridium (Ir), platinum (Pt)) having durability against discharge superior to that of the main body 37. It is to be noted that the second tip 39 may be omitted.

The main body 37 has an outer layer 31, and an inner layer 32 disposed on the inner circumferential side of the outer layer 31. The outer layer 31 is composed of a material (for instance, an alloy containing nickel as the main component) having oxidation resistance superior to the oxidation resistance of the inner layer 32. The inner layer 32 is composed of a material (for instance, an alloy containing pure copper, copper as the main component) having a thermal conductivity higher than the thermal conductivity of the outer layer 31. It is to be noted that the inner layer 32 may be omitted.

A-2. Manufacturing Method

Figure 2:
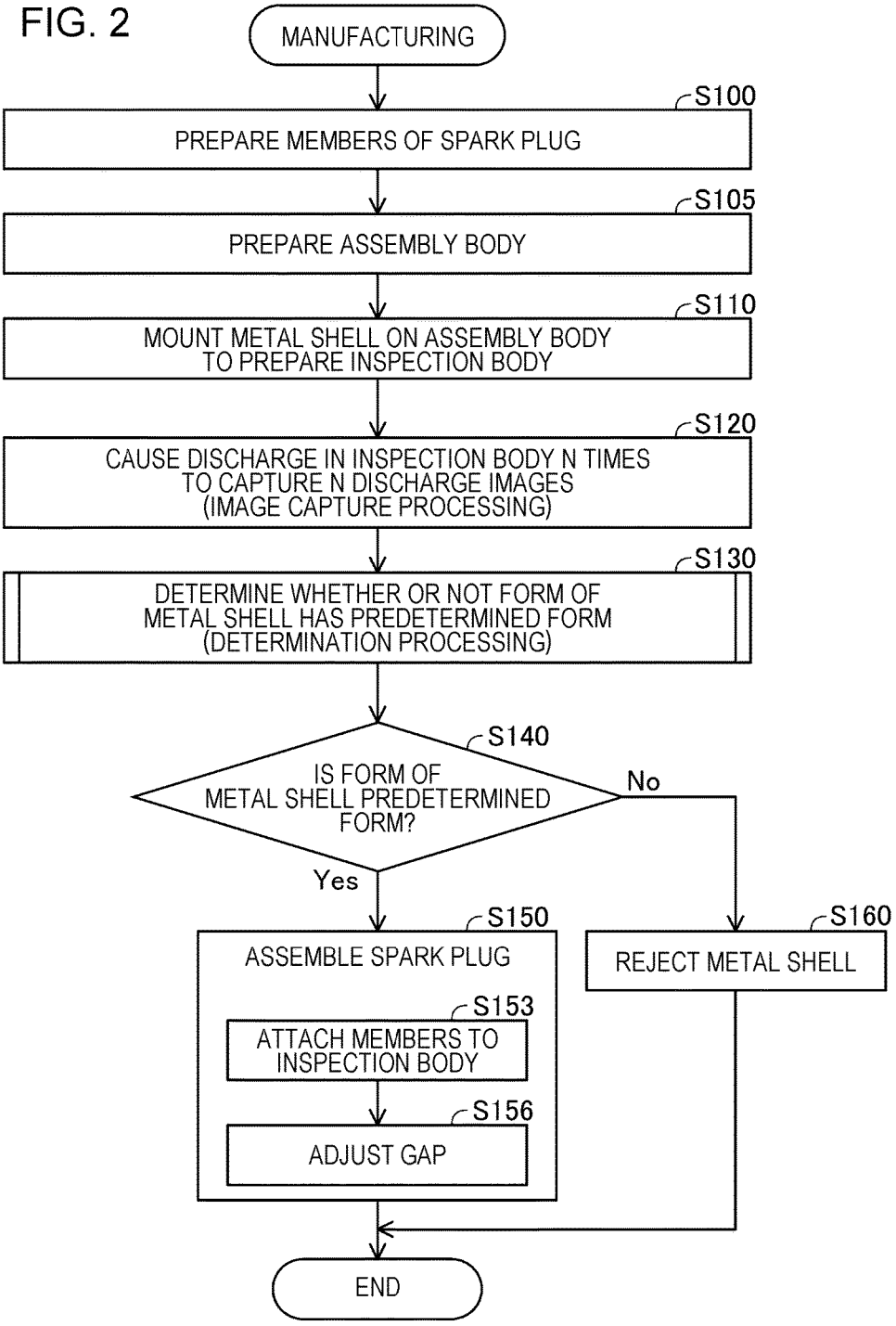
FIG. 2 is a flowchart illustrating an example of a method of manufacturing the spark plug.

FIG. 2 is a flowchart illustrating an example of a method of manufacturing the spark plug 100. In S100, members to be included in the spark plug 100 are prepared. Specifically, members including the metal shell 50, the insulator 10, the center electrode 20, the rod-like ground electrode 30, the powder material for each of the seal portions 72, 74 and the resistive element 73, and the metal terminal 40 are prepared. As a method of preparing these members, various publicly known methods may be used (detailed description is omitted). The metal shell 50 is prepared, for instance, by forging and cutting a cylindrical metal member.

In S105, an assembly body for inspection including the insulator 10 and the center electrode 20 is prepared. The assembly body is a member including the insulator 10, the center electrode 20, the members 72, 73, 74, and the metal terminal 40.

The assembly body 110 is prepared by the following steps, for instance. The center electrode 20 is inserted in an opening on the rear direction Dfr side of the insulator 10. The center electrode 20 is supported by the inner diameter reduction portion 11 of the insulator 10, and is disposed at a predetermined position in the through hole 12. Subsequently, the powder material for each of the first seal portion 72, the resistive element 73, the second seal portion 74 is loaded in and the loaded powder material is molded in the order of the members 72, 73, 74. The powder material is loaded in the through hole 12 through an opening on the rear direction Dfr side of the insulator 10. Subsequently, the insulator 10 is heated up to a predetermined temperature higher than the softening point of the glass component contained in the powder material of the members 72, 73, and 74, and the axial portion 41 of the metal terminal 40 is inserted in the through hole 12 through the opening on the rear direction Dfr side of the insulator 10 with heated up to a predetermined temperature. Consequently, the powder material for the members 72, 73, 74 is compressed and sintered, and thus the members 72, 73, and 74 are formed. The metal terminal 40 is then fixed to the insulator 10. Thus, the assembly body 110 is prepared.

In S110, the metal shell 50 is mounted on the assembly body 110, and thus an inspection body is prepared. As described later, whether the metal shell 50 is appropriate is determined using the inspection body. The inspection body is prepared by the following steps, for instance. The ground electrode 30 is bonded to the front end face 55 of the metal shell 50. The front end-side packing 8, the assembly body 110, the ring member 62, the talc 70, and the ring member 61 are disposed in the through hole 59 of the metal shell 50. The rear end portion 53 of the metal shell 50 is swaged so as to be inwardly bent, and thus the metal shell 50 is fixed to the insulator 10 of the assembly body 110. Thus, the inspection body is prepared. It is to be noted that bonding of the ground electrode 30 may be performed after the assembly body 110 is mounted in the metal shell 50. Alternatively, bonding of the ground electrode 30 may be performed in S150 after the later-described inspection.

In S120 and S130, processing which inspects main body fittings 50 is performed. In this embodiment, in order to inspect the metal shell 50, an image of an inspection body with discharge occurred is captured, the captured image is analyzed, and it is determined whether or not the form of the metal shell 50 is a predetermined form according to a result of the analysis.

As described later, when the form of the metal shell 50 is determined to be a predetermined form, the inspection body (that is, the metal shell 50 and the assembly body 110) is utilized as it is for manufacturing the spark plug 100. When the form of the metal shell 50 is not determined to be a predetermined form, the inspection body is not utilized for manufacturing the spark plug 100. Like this, in the stage of inspection, it is not decided yet whether or not the assembly body 110 is finally utilized for assembly of the spark plug 100. Consequently, in the stage of inspection, the members (for instance, the insulator 10, and the center electrode 20) of the assembly body 110 may be called temporary members.

Figure 3:
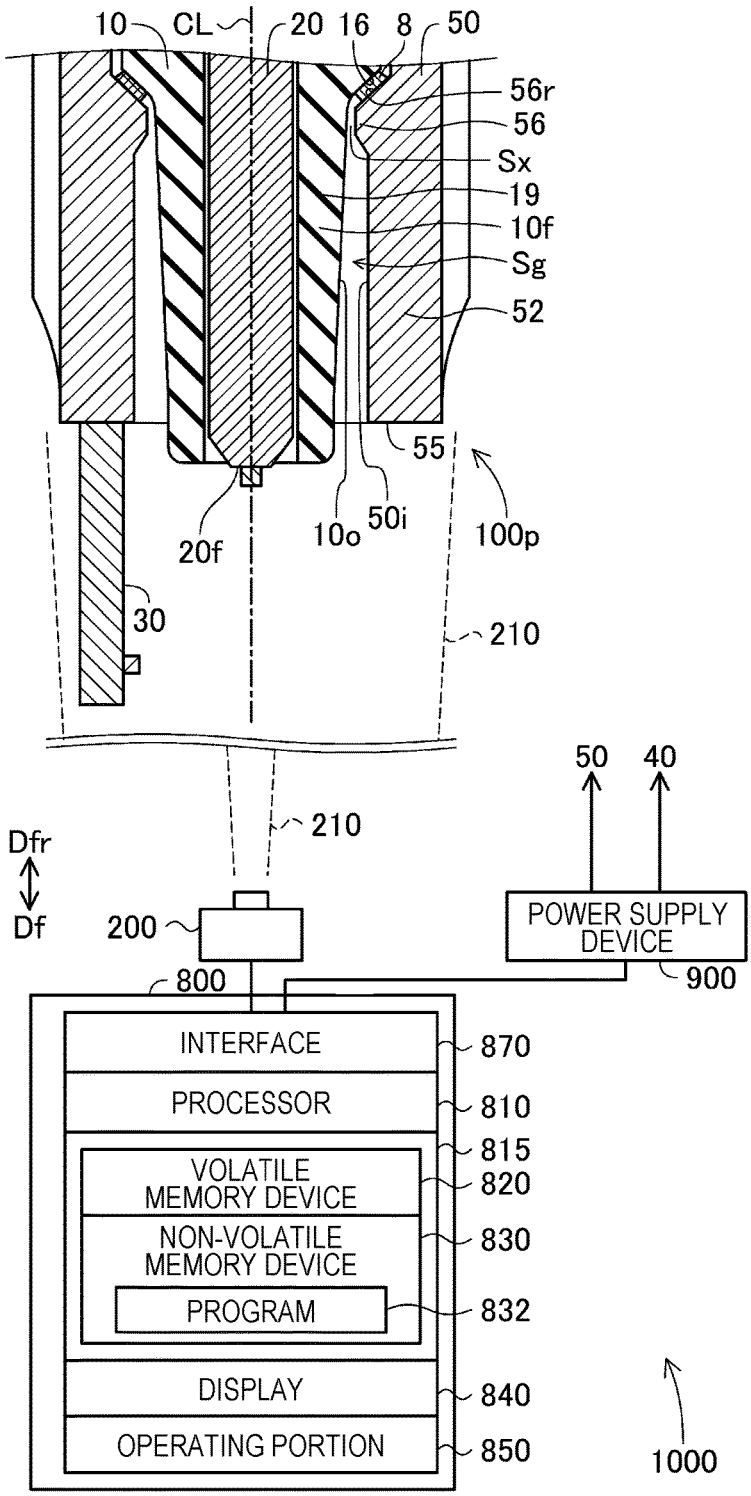
FIG. 3 is a schematic diagram illustrating an example of an inspection system.

FIG. 3 is a schematic diagram illustrating an example of an inspection system 1000. In this embodiment, the inspection system 1000 includes a power supply device 900 that applies a voltage for discharge to the metal shell 50 and the metal terminal 40 (FIG. 1) of an inspection body 100*p*, a digital camera 200 that photographs the inspection body 100*p*, and a processing device 800 that analyzes image data generated by the digital camera 200.

FIG. 3 illustrates a cross section including the axis CL in part of the inspection body 100*p* on the front direction Df side, in addition to the schematic diagram of the inspection system 1000. In the cross sectional view of the inspection body 100*p*, illustration of the internal configuration of the center electrode 20 and the internal configuration of the ground electrode 30 is omitted. Annular space Sg having an opening on the front direction Df side is formed between an outer circumferential surface 10*o* of the front end portion 10*f* (here, the outer diameter reduction portion 16 and the leg portion 19) which is a portion, on the front direction Df side, of the insulator 10, and an inner circumferential surface 50*i* of the metal shell 50. The annular space Sg is a portion, in which combustion gas can flow, of the space interposed between the inner circumferential surface 50*i* of the metal shell 50 and the outer circumferential surface 10*o* of the insulator 10. A gap portion Sx in FIG. 3 is a portion of the annular space Sg, the portion being interposed between the insulator 10 and the projection portion 56 of the metal shell 50. The distance between the outer circumferential surface 10*o* of insulator 10 and the inner circumferential surface 50*i* of the metal shell 50 in the gap portion Sx is smaller than the distance in other portions of the annular space Sg.

The inspection body 100*p* is disposed in a pressure chamber which is not illustrated. In this embodiment, the inspection body 100*p* is disposed in pressurized air. When the form of the inner circumferential surface 50*i* of the metal shell 50 is an appropriate form, the pressure in the pressure chamber is determined in advance so that discharge crossing the portions, other than the gap portion Sx, in the annular space Sg does not occur (in general, with a higher pressure, occurrence of aerial discharge is reduced over a longer distance).

The digital camera 200 is disposed on the front Df side of the inspection body 100*p*. The digital camera 200 faces in the rear direction Dfr. An imaging range 210 of the digital camera 200 includes the center electrode 20, the insulator 10, the annular space Sg which is present between the insulator 10 and the metal shell 50 and has an opening on the front end side, and the metal shell 50. It is to be noted that the digital camera 200 photographs the inspection body 100*p* from the outside of the pressure chamber through a window of the pressure chamber. Alternatively, both the digital camera 200 and the inspection body 100*p* may be disposed in the pressure chamber.

The processing device 800 is, for instance, a personal computer (for instance, a desktop computer, or a tablet computer). The processing device 800 a processor 810, a memory device 815, a display 840 that displays an image, an operating portion 850 that receives an operation by a user, and an interface 870. The memory device 815 includes a volatile memory device 820, and a non-volatile memory device 830. The components of the processing device 800 are connected to each other via a bus.

The processor 810 is a device that performs data processing, and is, for instance, a CPU. The volatile memory device 820 is, for instance, a DRAM, and the non-volatile memory device 830 is, for instance, a flash memory. The non-volatile memory device 830 stores a program 832. The processor 810 controls the digital camera 200 and the power supply device 900, obtains image data from the digital camera 200, analyzes the obtained image data, and inspects the metal shell 50 by executing the program 832 (the details will be described later). The processor 810 temporarily stores various intermediate data utilized for execution of the program 832 in the memory storage 815 (for instance, one of the volatile memory device 820 and the non-volatile memory device 830).

The display 840 is a device that displays an image, for instance, a liquid crystal display. The operating portion 850 is a device that receives an operation by a user, for instance, a touch panel disposed on the display 840. A user can input various instructions to the processing device 800 by operating the operating portion 850. The interface 870 is an interface (for instance, a USB interface) for communicating with other devices. The digital camera 200 and the power supply device 900 are connected to the interface 870.

In S120 of FIG. 2, a user inputs an instruction for starting inspection processing by operating the operating portion 850 of the processing device 800. In response to the instruction, the processor 810 starts inspection processing in accordance with the program 832. Specifically, in S120, the processor 810 controls the power supply device 900, thereby causing the power supply device 900 to apply a voltage for discharge across the metal terminal 40 and the metal shell 50 of the inspection body 100*p*. Thus, a voltage is applied across the center electrode 20 and the metal shell 50, and discharge occurs between the center electrode 20 and the metal shell 50. The processor 810 controls the digital camera 200, thereby causing the digital camera 200 to capture an image of the inspection body 100*p* with discharge occurred. The processor 810 causes the digital camera 200 to capture an image in synchronization with the timing of voltage application by the power supply device 900, for instance. The processor 810 obtains image data generated in the image capturing from the digital camera 200. In this embodiment, the image data generated by the digital camera 200 is bit map data indicating a discharge image which is an image indicating the inspection body 100*p* with discharge occurred. The bit map data indicates the color values of each of multiple pixels indicating a discharge image. The color values of each pixel include, for instance, the values (hereinafter also called R value, G value, and B value) of three color components: red (R), green (G), and blue (B). The number of gradations of each component value is 256 gradations, for instance.

Figure 4A:
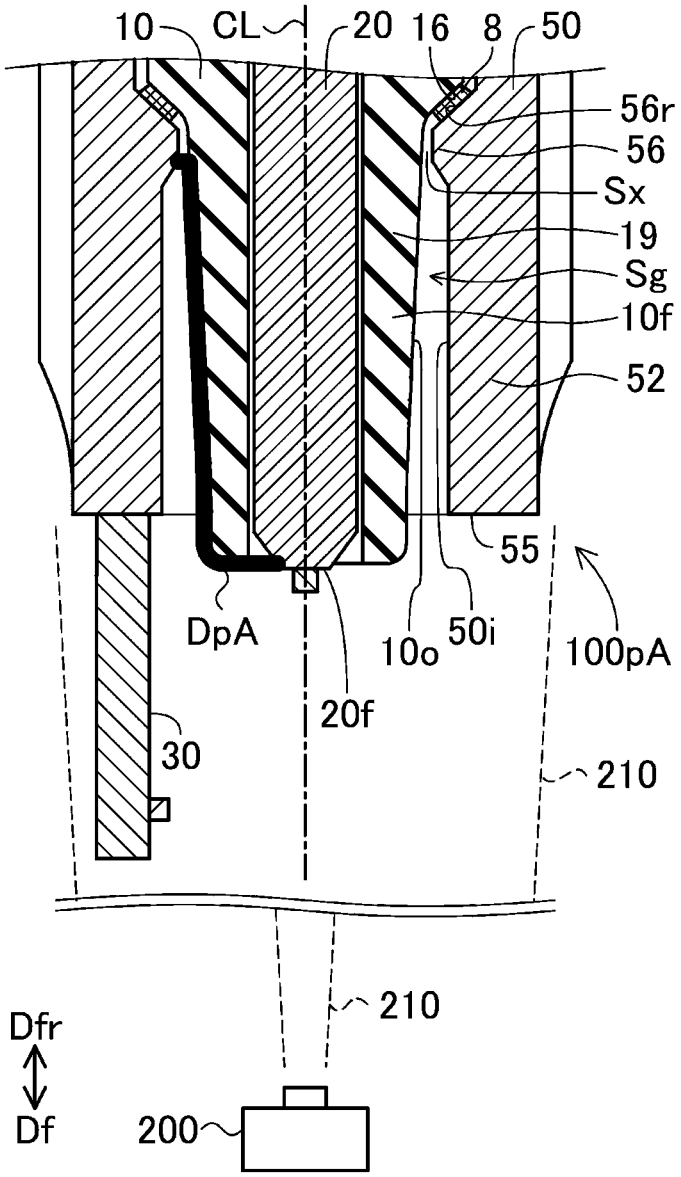
FIGS. 4A to 4D are schematic diagrams of examples of discharge paths and examples of discharge images in inspection bodies.
Figure 4B:
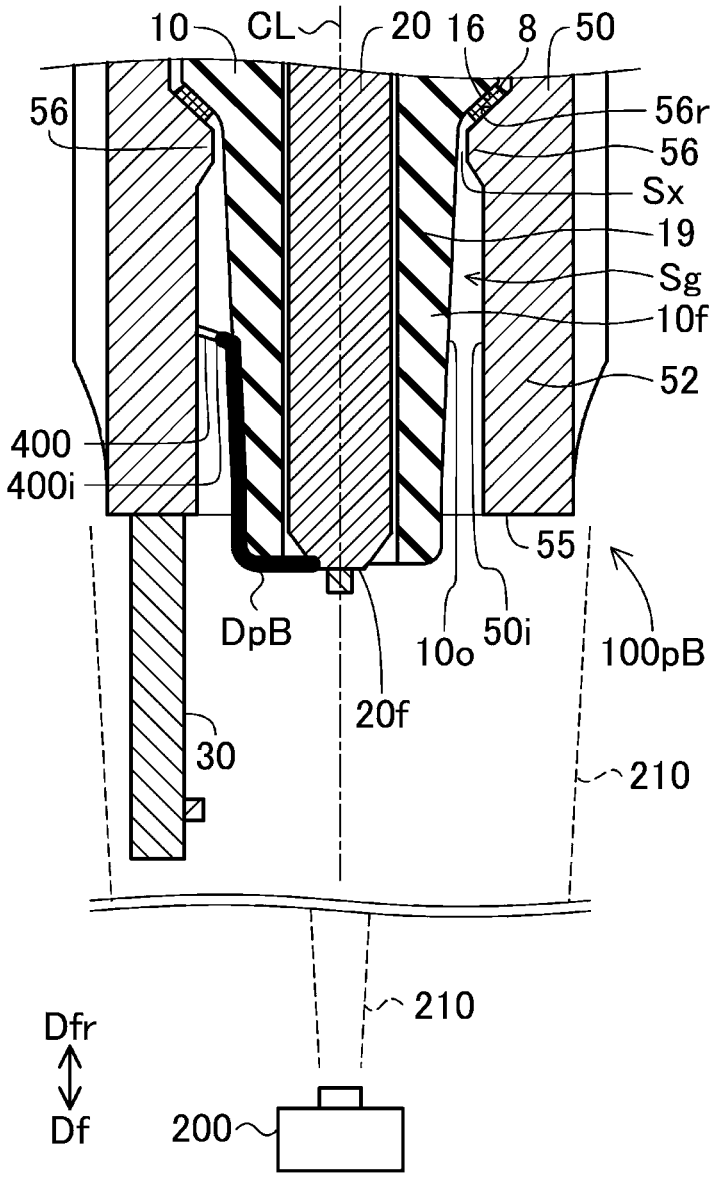

FIGS. 4A to 4D are schematic diagrams of examples of discharge paths and examples of discharge images in inspection bodies. FIGS. 4A and 4B illustrate cross sections including the axis CL in part of the inspection bodies 100*p*A, 100*p*B on the front direction Df side. The difference between these inspection bodies 100*p*A and 100*p*B is only in that the form of the inner circumferential surface 50*i* of the metal shell 50 is different from each other. The form of the inner circumferential surface 50*i* of the metal shell 50 of the inspection body 100*p*A in FIG. 4A is a predetermined form, and is the intended appropriate form. The form of the inner circumferential surface 50*i* of the metal shell 50 of the inspection body 100*p*B in FIG. 4B is an unintended inappropriate form in which a foreign material 400 adheres to the inner circumferential surface 50*i*. The foreign material 400 is, for instance, a chip generated when the metal shell is cut.

Discharge DpA, DpB indicated by a thick line in FIGS. 4A and 4B illustrates an example of discharge which may occur in the inspection bodies 100*p*A, 100*p*B. In the inspection body 100*p*A illustrated in FIG. 4A, from the front end portion 20*f* of the center electrode 20, the discharge DpA passes along the outer circumferential surface 10*o* of the insulator 10 (here, the leg portion 19), and follows a path from the outer circumferential surface 10*o* of the insulator 10 to the projection portion 56 in the vicinity of the projection portion 56 of the metal shell 50. As described above, the inspection body 100*p*A is placed under a pressurized environment, and thus discharge passes through the gap portion Sx which is a small gap, and not passed through a large gap in the annular space Sg.

In the inspection body 100*p*B illustrated in FIG. 4B, the foreign material 400 adheres to the inner circumferential surface 50*i* of the metal shell 50. An innermost circumferential side end 400*i* of the foreign material 400 is positioned closer to the inner circumferential side than the projection portion 56. Also, the foreign material 400 is closer to the front end portion 20*f* of the center electrode 20 than the projection portion 56. From the front end portion 20*f* of the center electrode 20, the discharge DpB passes along the outer circumferential surface 10*o* of the insulator 10, and follows a path from the outer circumferential surface 10*o* of the insulator 10 to the end 400*i* of the foreign material 400 in the vicinity of the foreign material 400. The path of the discharge DpB is within the range that is on the front direction Df side of the foreign material 400, and on the inner circumferential side of the end 400*i* of the foreign material 400.

When such a foreign material 400 has adhered to the inner circumferential surface 50*i* of the metal shell 50 of a completed spark plug 100, discharge may occur along the path of the discharge DpB of FIG. 4B, and not between the center electrode 20 and the ground electrodes 30. When discharge along such an intended path is repeated, the discharge is repeatedly passed through a portion, of the insulator 10, in the vicinity of the foreign material 400, and thus the portion of the insulator 10 may be damaged (for instance, a pinhole may be formed). For this reason, it is preferable to use a metal shell 50 without such a foreign material 400 for assembly of the spark plug 100.

Figure 4C:
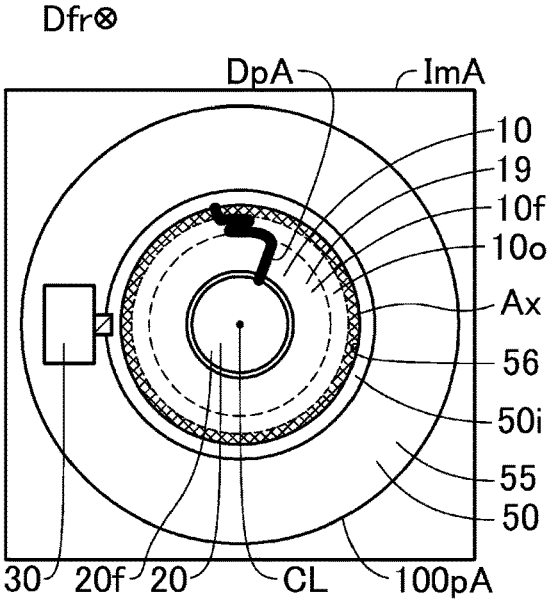
Figure 4D:
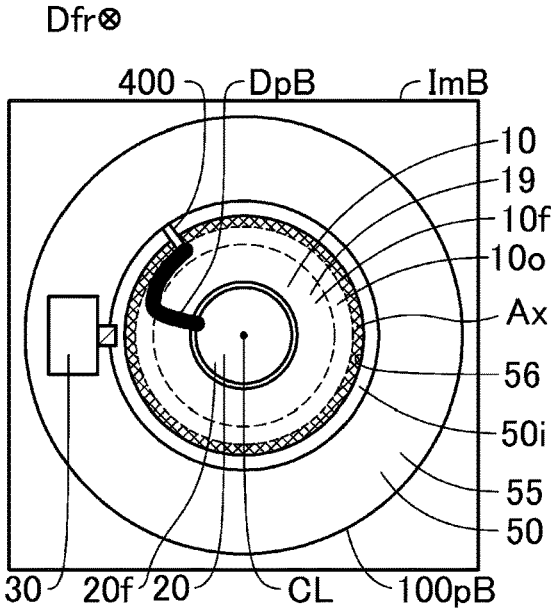

FIGS. 4C and 4D each illustrate an example of a discharge image. A discharge image ImA of FIG. 4C represents the inspection body 100*p*A of FIG. 4A, and a discharge image ImA of FIG. 4C represents inspection body 100*p*B of FIG. 4B. An area Ax with hatching in FIGS. 4C and 4D indicates the gap portion Sx between the insulator 10 and the projection portion 56 of the metal shell 50 (also called the gap area Ax). As illustrated in FIG. 4A, when the form of the inner circumferential surface 50*i* of the metal shell 50 is a predetermined form, on the discharge image ImA (FIG. 4C), discharge crosses the gap area Ax like the discharge DpA, and passes through a path connecting the center electrode 20 and the projection portion 56 of the metal shell 50. As illustrated in FIG. 4B, when the foreign material 400 adheres to the inner circumferential surface 50*i* of the metal shell 50, on the discharge image ImB (FIG. 4D), discharge does not cross the gap area Ax, but passes through a path connecting the center electrode 20 and the foreign material 400 like the discharge DpB. Like this, when the discharge path does not cross the gap area Ax and does not reach the metal shell 50, the form of the inner circumferential surface 50*i* of the metal shell 50 can be determined to be not a predetermined form as the form of the inner circumferential surface 50*i* of the metal shell 50 of FIG. 4B.

In S120 of FIG. 2, the processor 810 obtains N pieces of image data indicating N (N is an integer greater than or equal to 2) discharge images (N is 100 in this embodiment). Specifically, the processor 810 applies a voltage for discharge to the inspection body 100*p* multiple times by controlling the power supply device 900. The processor 810 causes the digital camera 200 to capture an image of the inspection body 100*p* in synchronization with the timing of each voltage application. Thus, the digital camera 200 generates N pieces of image data indicating N discharge images indicating mutually different discharge states. The processor 810 obtains N pieces of image data from the digital camera 200.

It is to be noted that discharge may not occur in spite of applying a voltage to the inspection body 100*p*. Thus, in this embodiment, it is determined whether or not discharge has occurred in response to application of a voltage, and voltage application and image capturing are repeated until N pieces of image data indicating N discharge images indicating discharge are generated. As a method of determining whether or not discharge has occurred, various methods may be used. For instance, the processor 810 may monitor the waveform of a voltage outputted by the power supply device 900, and when a sudden change in the voltage in association with discharge is not detected, may determine that discharge has not occurred. Alternatively, the processor 810 may analyzes the image data, and when a bright area indicating discharge is not detected, may determine that discharge has not occurred.

In S130 of FIG. 2, the processor 810 (FIG. 3) analyzes the image data (in other words, the discharge image) obtained in S120, and determines whether or not the form of the inner circumferential surface 50*i* of the metal shell 50 a predetermined form.

Figure 5:
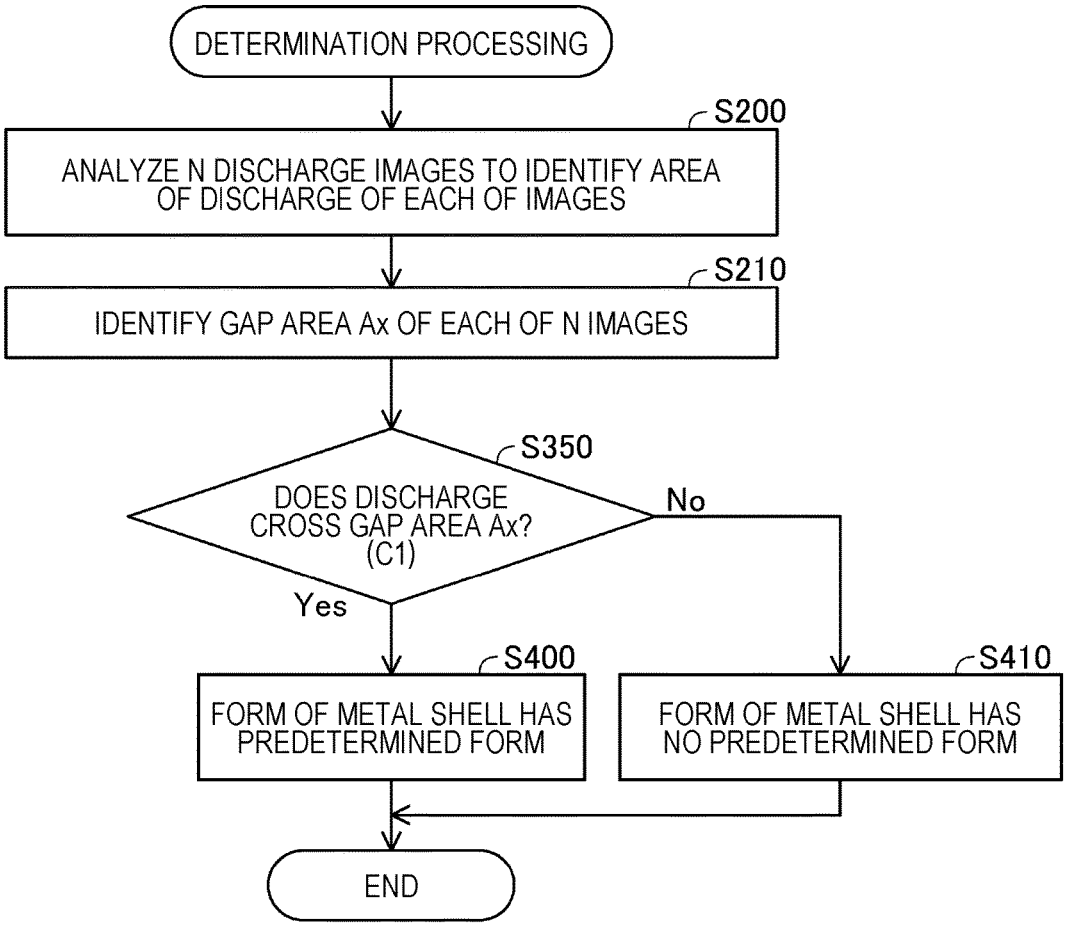
FIG. 5 is a flowchart illustrating an example of determination processing.

FIG. 5 is a flowchart illustrating an example of determination processing. In S200, the processor 810 identifies the area (that is, the area indicating a spark) of discharge in each discharge image by analyzing the N discharge images. As a method of identifying an area indicating discharge, various methods may be used. In general, on a discharge image, a portion indicating discharge (that is, a spark) is illustrated with a brighter color compared with other portions. In this embodiment, the processor 810 binarizes each discharge image according to its brightness, and classifies multiple pixels indicating the discharge image into candidates of a pixel indicating discharge (called candidate pixels), and other pixels. A threshold value for the binarization is determined experimentally in advance. Alternatively, the processor 810 may analyzes a discharge image, thereby determining a threshold value for the binarization so that a bright pixel indicating discharge can be distinguished from other pixels. In this case, a threshold value for the binarization may be determined for each discharge image. In either case, the processor 810 identifies an area with contiguous multiple candidate pixels as the area indicating discharge. Here, when multiple areas away from each other are detected, the largest area may be identified as the area of discharge. The processor 810 identifies one area of discharge from one discharge image. In the examples of FIGS. 4C and 4D, the area indicating each of the discharge DpA, DpB is identified as the area indicating discharge.

It is to be noted that the brightness of a pixel is identified using the pixel color values. for instance, the gradation value of green G may be used as the brightness. Alternatively, a brightness may be calculated by an operation such as (R+2×G+B)/4. Alternatively, the color value indicated by the image data generated by the digital camera 200 may include a color value indicating a brightness (for instance, the image data may be bit map data with gray scales). In this case, the processor 810 may identify the area indicating discharge using a color value indicating a brightness.

In S210, the processor 810 identifies the gap area Ax in each of the N discharge images. As a method of identifying a gap area Ax, various methods may be used. In this embodiment, the size and the shape of each component of the spark plug 100 are predetermined. The position of the inspection body 100*p* with respect to the digital camera 200 is predetermined. Thus, the processor 810 may identify a predetermined annular area on a discharge image as the gap area Ax. Alternatively, the processor 810 may identify the gap area Ax for each discharge image by analyzing the discharge image. The processor 810 may identify, for instance, an annular area indicating the color of the insulator 10 in the discharge image, may approximate the annular edge on the outer circumferential side of the identified annular area by a circle, may identify the position of the center of the approximating circle as the position of the axis CL, and may identify an annular area having a predetermined size at the center on the identified axis CL as the gap area Ax. In the examples of FIGS. 4C and 4D, the gap area Ax is identified.

In S350, the processor 810 determines whether or not condition C1 is satisfied. The condition C1 is a condition for determining that discharge can cross the gap area Ax freely on a discharge image (also called a cross condition C1). In this embodiment, the condition C1 is as follows.

(Condition C1): Discharge Crosses the Gap Area Ax in all of the N Discharge Images As a method of determining whether or not discharge crosses the gap area Ax in the discharge image, various methods may be used. For instance, when both of at least part of the annular inner circumferential edge and at least part of the annular outer circumferential edge of the annular gap area Ax are included in the area of discharge, the processor 810 may determine that discharge crosses the gap area Ax. In this embodiment, the area indicating discharge is one continuous area. Thus, when the area indicating discharge includes both the pixels on the inner circumferential side from the annular inner circumferential edge of the gap area Ax, and the pixels on the outer circumferential side from the annular outer circumferential edge of the gap area Ax, the processor 810 may determine that discharge crosses the gap area Ax. In the example of FIG. 4C, it is determined that the discharge DpA crosses the gap area Ax, and in the example of FIG. 4D, it is determined that the discharge DpA does not cross the gap area Ax.

When the condition C1 is satisfied (Yes in S350), the processor 810 determines in S400 that the form of the metal shell 50 is a predetermined form (in other words, an appropriate form). The processor 810 outputs result information indicating a result of the determination to a device that receives result information. For instance, the processor 810 outputs the result information to the display 840, and causes the display 840 to display the result of the determination. A user can identify the result of the determination by observing the display 840. Also, the processor 810 may output the result information to a memory device (for instance, the nonvolatile memory device 830) (that is, the result information may be stored in a memory device). A user can identify a determination result by referring to a data processing device (for instance, the processing device 800) used for inspection, or result information stored in a memory storage. The processor 810 then completes the processing of FIG. 5.

When the condition C1 is not satisfied, in other words, when it is determined that discharge does not cross the gap area Ax in at least one of the N discharge images (No in S350), the processor 810 determines in S410 that the form of the metal shell is not a predetermined form. Similarly to S400, the processor 810 outputs result information indicating a result of the determination to a device that receives result information. The processor 810 then completes the processing of FIG. 5.

When the processing of FIG. 5, that is, S130 of FIG. 2 is ends, the result of the determination in S130 is verified in S140. S140 may be performed by a user, or instead, S140 may be performed by a device such as the processing device 800.

When the determination result in S130 indicates that "the form of the metal shell is a predetermined form" (Yes in S140), the spark plug 100 is assembled using the inspection body in S150. In this embodiment, the remaining members (for instance, the gasket 90) of the spark plug 100 are mounted in the inspection body (S153). The distance of the gap g is adjusted by bending a rod-like ground electrode 30 (FIG. 3) of the inspection body (S156). Thus, the spark plug 100 is completed, and the processing of FIG. 2 is ended. It is to be noted that S153 may be performed after S156. Alternatively, instead of utilizing the inspection body as it is, the assembly body 110 for inspection may be removed from the metal shell 50 of the inspection body, or the inspected metal shell 50 may be mounted on an assembly body 110 separately prepared.

When the determination result in S130 indicates that "the form of the metal shell is not a predetermined form" (No in S140), the metal shell is rejected, and excluded from the manufacturing objects (S160). Thus, the processing of FIG. 2 is ended. The metal shell excluded from the manufacturing objects may be reused in S110 after reproduction processing. The reproduction processing may be any processing that can change the form of the inner circumferential surface of the metal shell to a predetermined form. For instance, the reproduction processing may be cutting or cleaning.

As described above, in this embodiment, the metal shell 50 is mounted on the assembly body 110 including the insulator 10 and the center electrode 20 (S110 of FIG. 2), and a voltage is applied across the metal shell 50 and the center electrode 20 under the atmosphere of a predetermined pressure condition (S120). An image of a range including the center electrode 20, the insulator 10, the annular space Sg which is present between the insulator 10 and the metal shell 50 and has an opening on the front end side, and the metal shell 50 is captured with discharge occurred from the front direction Df side in the direction of the axis CL (S120 of FIG. 3). It is determined whether or not the form of the inner circumferential surface 50*i* of the metal shell 50 is a predetermined form by analyzing the image generated by the image capturing (S130 of FIG. 5). When the form of the inner circumferential surface 50*i* of the metal shell 50 is determined to be a predetermined form (Yes in S140), the spark plug 100 is assembled using the metal shell 50 (S150). Like this, the image to be analyzed for determining whether or not the form of the inner circumferential surface 50*i* of the metal shell 50 is a predetermined form is an image captured from the front direction Df side in the direction of the axis CL with discharge occurred between the center electrode 20 and the metal shells 50, and is the image of a range including the center electrode 20, the insulator 10, the annular space Sg which is present between the insulator 10 and the metal shell 50 and has an opening on the front end side, and the metal shell 50. Consequently, whether or not the inner circumferential surface 50*i* of the metal shell 50 has a predetermined form can be appropriately determined.

When the form of the inner circumferential surface 50*i* of the metal shell 50 is determined to be not a predetermined form (No in S140), the metal shell 50 is not utilized for manufacturing the spark plug 100. Thus, manufacturing of the spark plug 100 is avoided, which includes a foreign material which adheres to the inner circumferential surface 50*i* of the metal shell 50 as in the inspection body 100*p*B of FIG. 4B. Consequently, occurrence of damage of insulator 10, caused by a foreign material is reduced.

When the form of the inner circumferential surface 50*i* of the metal shell 50 is a predetermined form, a pressure condition for image capturing is determined in advance so that discharge does not occur at a portion, other than the projection portion 56, in the metal shell 50. Thus, a discharge path may be different between the predetermined form of the inner circumferential surface 50*i* of the metal shell 50 and other forms. Consequently, the accuracy of determination based on the analysis of an image can be improved.

As described related to S150 of FIG. 2, in this embodiment, the assembly body 110 used for inspection (that is, a member including the insulator 10 and the center electrode 20) is utilized as it is for assembly of the spark plug 100. Thus, the insulator 10 and the center electrode 20 (eventually, the assembly body 110) used for inspection are not removed from the inspected metal shell 50. If the assembly body 110 for inspection is removed from the metal shell 50, due to the removal, a foreign material may adhere to the inner circumferential surface 50*i* of the metal shell 50. In this manner, the form of the inner circumferential surface 50*i* of the metal shell 50 can be changed from a predetermined form to another form. In this embodiment, such a defect is reduced. Consequently, when the form of the inner circumferential surface 50*i* of the metal shell 50 is determined to be a predetermined form in S130 of FIG. 2, a spark plug can be manufactured using the metal shell 50 in an appropriate form.

Also, as described with reference to FIG. 1, the spark plug 100 includes the ground electrode 30 connected to the metal shell 50, and a discharge gap g facing the center electrode 20 is formed by the ground electrode 30. As described related to S120 of FIG. 2, at the time of image capturing, before the ground electrode 30 is disposed at a position facing the center electrode 20 (before the gap g is adjusted by bending the rod-like ground electrode 30 in this embodiment), discharge is generated. Thus, in the inspection, occurrence of discharge between the center electrode 20 and the ground electrodes 30 is reduced. Consequently, it is possible to obtain an appropriate image for determining whether or not the form of the inner circumferential surface 50*i* of the metal shell 50 is a predetermined form. Specifically, the discharge path may be changed according to the form of the inner circumferential surface 50*i*. Whether or not the inner circumferential surface 50*i* of the metal shell 50 has a predetermined form can be appropriately determined by using such an discharge image.

As described with reference to FIG. 1, the metal shell 50 includes the projection portion 56 that projects inwardly in the radial direction. The insulator 10 (specifically, the outer diameter reduction portion 16) is supported by the projection portion 56 from the front direction Df side. As described with reference to FIG. 4, FIG. 5, the determination processing in S130 of FIG. 2 includes determining whether or not discharge crosses the gap area Ax between the insulator 10 and the projection portion 56 of the metal shell 50 on the discharge image. Consequently, on the image obtained by the image capturing, it is possible to distinguish a state where a foreign material (for instance, the foreign material 400 of FIG. 4D), which overlaps with the gap area Ax between the insulator 10 and the projection portion 56 of the metal shell 50, adheres to the inner circumferential surface 50*i* of the metal shell 50 from a state where such a foreign material does not adhere to the inner circumferential surface 50*i* of the metal shell 50. Consequently, whether or not the inner circumferential surface of the metal shell has a predetermined form can be appropriately determined.

Also, as described related to S120, S130 of FIG. 2, N pieces of image data indicating N discharge images are used for inspection of the metal shell 50. The accuracy of determination of whether or not the inner circumferential surface 50*i* of the metal shell 50 has a predetermined form can be improved by using multiple discharge images.

B. Second Embodiment

Figure 6:
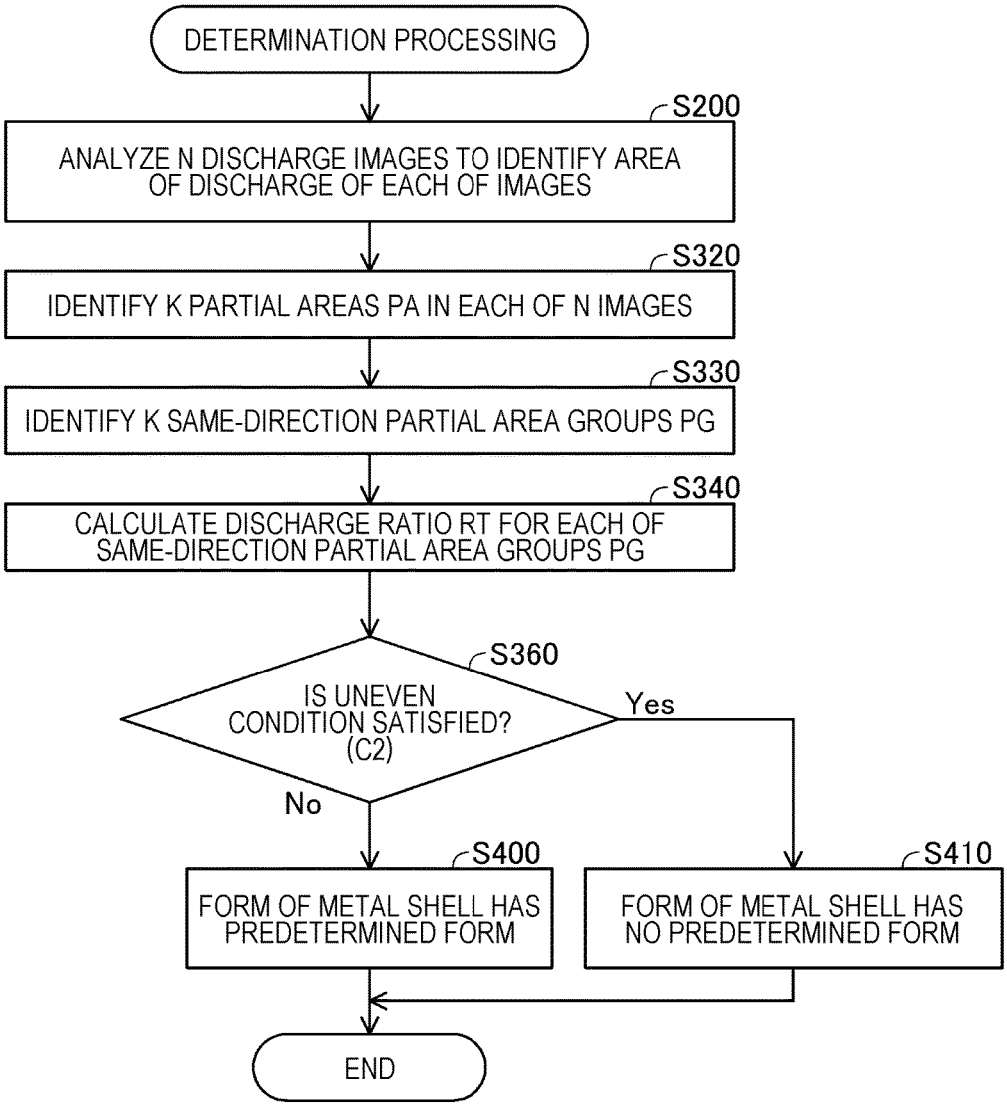
FIG. 6 is a flowchart illustrating a second embodiment of the determination processing.

FIG. 6 is a flowchart illustrating a second embodiment of the determination processing (S130) of FIG. 2. The processing other than S130 in the manufacturing method is the same as corresponding processing in the first embodiment of FIG.

2. The program 832 of the processing device 800 (FIG. 3) is configured so as to execute the processing in the second embodiment.

Figure 7A:
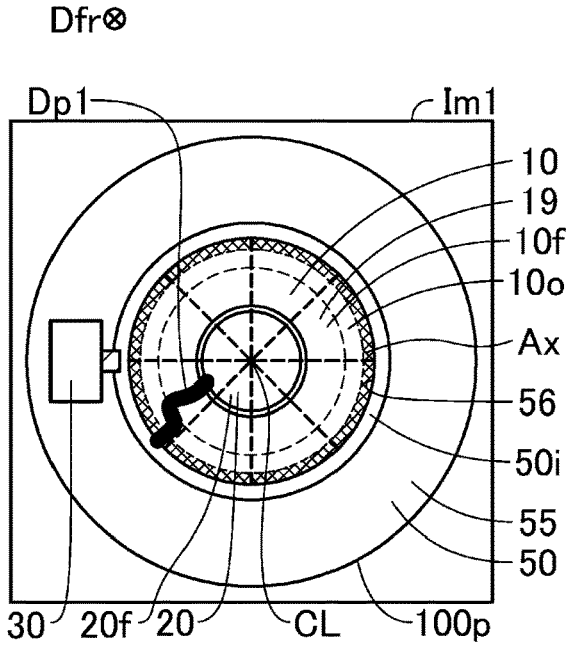
FIGS. 7A to 7D are each an explanatory diagram of processing using multiple partial areas.
Figure 7B:
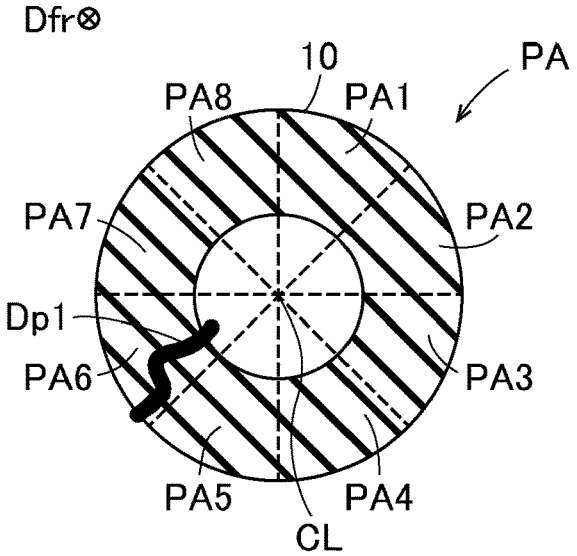

S200 is the same as S200 in FIG. 5. In the processing in and after S320, the processor 810 (FIG. 3) uses K (K is an integer greater than or equal to 2) partial areas of each of the N discharge images to determine whether or not the form of the inner circumferential surface 50*i* of the metal shell 50 is a predetermined form. FIGS. 7A to 7D are each an explanatory diagram of processing using multiple partial areas. FIG. 7A illustrates an example of a discharge image (called a discharge image Im1). The discharge image Im1 illustrates the inspection body 100*p* and discharge Dp1. FIG. 7B illustrates a portion, indicating the insulator 10, of the discharge image Im1. The annular area representing the insulator 10 is divided into 8 partial areas PA1 to PA8 (that is, K is 8 in this embodiment, however, K may be a value other than 8). These partial areas PA1 to PA8 are obtained by equiangularly dividing the annular area representing the insulator 10 radially around the axis CL at the center. The partial areas PA1 to PA8 are disposed side by side in the circumferential direction around the axis CL at the center. The directions from the axis CL to the partial areas PA1 to PA8 are different between the partial areas PA1 to PA8. Hereinafter, when the individual partial areas PA1 to PA8 do not need to be distinguished, each of the partial areas PA1 to PA8 is simply called a partial area PA.

In S320 (FIG. 6), the processor 810 identifies K partial areas PA for each of N discharge images (K=8 in this embodiment). As a method of identifying partial areas PA1 to PA8, various methods may be used. In this embodiment, the size and the shape of each component of the spark plug 100 are predetermined. The position of the inspection body 100*p* with respect to the digital camera 200 is predetermined. Therefore, the processor 810 may identify 8 areas with predetermined size, shape, and arrangement on a discharge image as the partial areas PA1 to PA8. Alternatively, the processor 810 may identify the partial areas PA1 to PA8 for each discharge image by analyzing the discharge images. The processor 810 may identify, for instance, an annular area indicating the color of the insulator 10 in the discharge image, may approximate the annular edge on the outer circumferential side of the identified annular area by a circle, may identify the position of the center of the approximating circle as the position of the axis CL, and may identify 8 areas having predetermined size, shape, and arrangement at the center on the identified axis CL as the partial areas PA1 to PA8.

Figure 7C:
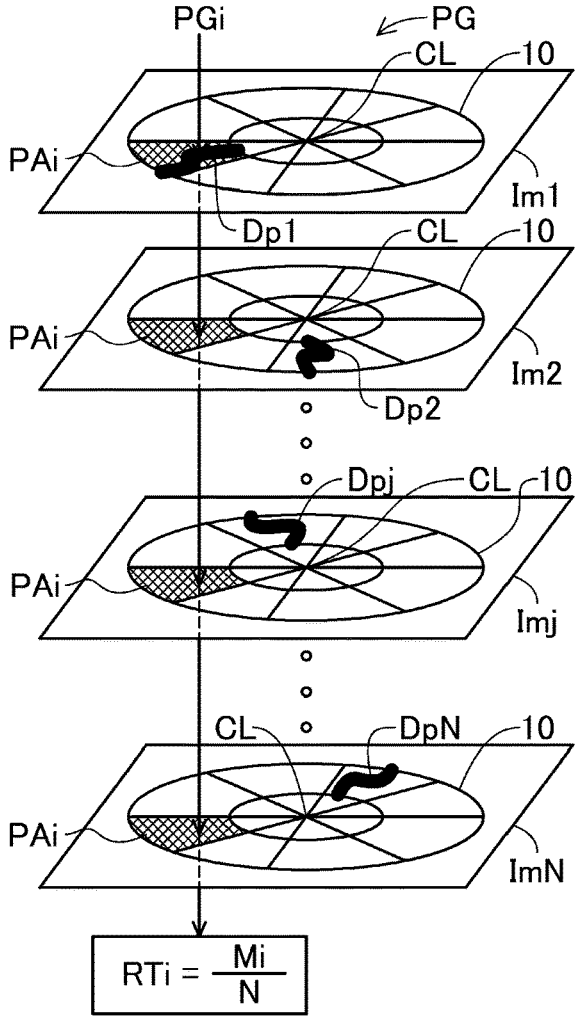

In S330 (FIG. 6), the processor 810 divides N×K partial areas PA in N discharge images into K same-direction partial area groups PG, each of which includes N same-direction partial areas PA. Here, the direction of a partial area PA is with reference to the axis CL (in other words, the direction of a partial area PA as viewed from the axis CL). FIG. 7C is an explanatory diagram of a same-direction partial area group. FIG. 7C illustrates N discharge images Imj (j is an integer in the range of from 1 to N), the ith partial area PAi, and the same-direction partial area group PGi in the ith direction. Each discharge image Imj indicates the insulator 10 and the discharge Dpj. As illustrated, one same-direction partial area group PGi includes N partial areas PAi in the same direction in the N discharge images Imj. In this embodiment, one discharge image includes K partial areas PA with different directions, and thus the processor 810 identifies K same-direction partial area groups with different directions. Hereinafter, when K same-direction partial area groups do not need to be distinguished, each of the K same-direction partial area groups is simply called a same-direction partial area group PG.

In S340 (FIG. 6), the processor 810 calculates a discharge ratio RT for each same-direction partial area group PG. The discharge ratio RT is the number M of discharge images indicating discharge crossing the partial area PA included in the same-direction partial area group PG to the total number N of discharge images (RT=M/N). FIG. 7C illustrates the calculation expression for the discharge ratio RTi of the same-direction partial area group PGi (RTi=Mi/N). The number Mi of discharge images is the total number of discharge images indicating discharge crossing the partial area PAi included in the same-direction partial area group PGi. For instance, when discharge crosses the partial area PAi only in one discharge image Im1 among the N discharge images Imj, the number Mi is 1, and the discharge ratio RTi is 1/N.

It is to be noted that discharge may cross multiple partial areas PA in one discharge image. In this case, as the partial area PA in which discharge crosses, the processor 810 identifies one partial area PA having the largest area of discharge included in the partial area PA among multiple partial areas PA indicating discharge. The processor 810 then calculates the discharge ratio RT of the same-direction partial area group PG using the one identified partial area PA.

When the form of the inner circumferential surface 50*i* of the metal shell 50 is a predetermined form like the inspection body 100*p*A of FIG. 4A, the structure of the annular space Sg is generally the same independently of the viewing direction from the axis CL. Therefore, N discharge occurrences are approximately evenly distributed in the circumferential direction. The variation in the discharge ratio RT among the K same-direction partial area groups PG is reduced. In contrast, when the form of the inner circumferential surface 50*i* of the metal shell 50 is different from a predetermined form like the inspection body 100*p*B of FIG. 4B, the structure of the annular space Sg may vary with the viewing direction from the axis CL. For instance, the distance of the gap in the radial direction is smaller at a portion in the annular space Sg, to which the foreign material 400 adheres than at other portions of the annular space Sg. Consequently, discharge may occur in a concentrated manner in a specific direction (for instance, the direction to the foreign material 400).

Figure 7D:
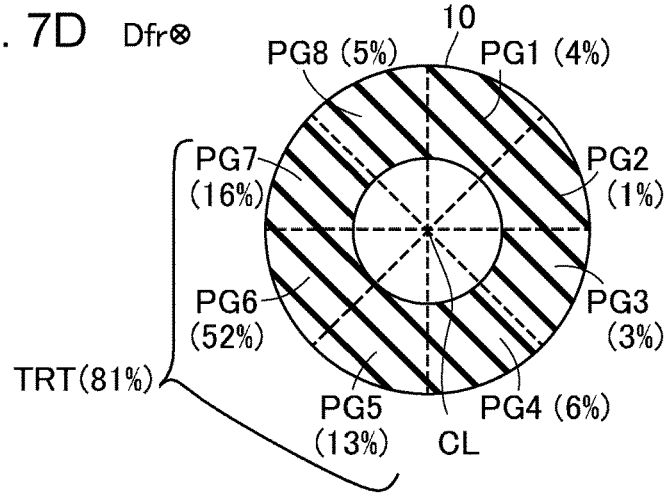

FIG. 7D is an explanatory diagram illustrating an example of distribution of the discharge ratio RT when the form of the inner circumferential surface 50*i* of the metal shell 50 is different from a predetermined form. FIG. 7D illustrates 8 same-direction partial area groups PG1 to PG8. The numerical value in a parenthesis near the symbol of a same-direction partial area group indicates the discharge ratio RT of the same-direction partial area group. For instance, the discharge ratio RT of the first same-direction partial area group PG1 is 4%, and the discharge ratio RT of the second same-direction partial area group PG2 is 1%. In the example of FIG. 7D, the discharge ratio RT (52%) of the 6th same-direction partial area group PG6 is the highest. The discharge is concentrated on the 6th same-direction partial area group PG6. In addition, the discharge ratios RT of the same-direction partial area groups PG5, PG7 adjacent to the 6th same-direction partial area group PG6 are also higher than the discharge ratios RT of the remaining same-direction partial area groups.

In S360 (FIG. 6), the processor 810 determines whether or not the condition C2 is satisfied. The condition C2 is a condition for determining that the positions of discharge in the circumferential direction are unevenly located in a partial range in the circumferential direction (also called uneven condition C2). In this embodiment, the condition C2 is as follows.

(Condition C2): a high area ratio TRT exceeds a predetermined threshold value, the high area ratio TRT being the total of L discharge ratios RT of circumferentially contiguous L ($1 \leq L < K$) same-direction partial area groups with the center at a same-direction partial area group having the highest discharge ratio RT. L is determined in advance and is 3 in this embodiment (however, L may be a value other than 3). The threshold value is experimentally determined in advance so that when N discharge occurrences are approximately evenly distributed in the circumferential direction, the threshold value is not met, but when N discharge occurrences are unevenly distributed in a partial range in the circumferential direction, the threshold value is met. Such a threshold value is larger than an even ratio that is the total of L discharge ratios RT of L same-direction partial area groups when N discharge occurrences are evenly distributed in the circumferential direction. When N discharge occurrences are evenly distributed in the circumferential direction, the discharge ratio RT of one same-direction partial region group is 1/K, and the total of L discharge ratios RT of L same-direction partial region groups is L/K. When L is 3 and K is 8, the even ratio is 37.5%. In this embodiment, the threshold value is 70% which is greater than the even ratio. It is to be noted that the threshold value is not limited to 70%, and may be various values greater than the even ratio.

In the example of FIG. 7D, the processor 810 calculates a high area ratio TRT which is the total of the discharge ratios of 3 circumferentially contiguous same-direction partial area groups PA5, PA6, PA7 with the center at the 6th partial area having the highest discharge ratio RT (TRT=81%). Since the calculated high area ratio TRT (81%) is greater than the threshold value (70%), the processor 810 determines that the condition C2 is satisfied.

When the condition C2 is satisfied (Yes in S360 of FIG. 6), the processor 810 determines in S410 that the form of the metal shell is not a predetermined form. The processing in S410 is the same as the processing in S410 of FIG. 5. The processor 810 then completes the processing of FIG. 6.

When the condition C2 is not satisfied (No in S360 of FIG. 6), the processor 810 determines in S400 that the form of the metal shell is a predetermined form. The processing in S400 is the same as the processing in S400 of FIG. 5. The processor 810 then completes the processing of FIG. 6.

As described above, in this embodiment, similarly to the first embodiment, N pieces of image data indicating N discharge images are generated for inspection of the metal shell 50 (S120 of FIG. 2). In S360 of FIG. 6, it is determined whether or not the condition C2 is satisfied, the condition C2 indicating that the positions of discharge in the circumferential direction around the axis CL at the center of N discharge images are unevenly distributed in a partial range in the circumferential direction. With this configuration, it is possible to distinguish a state where a foreign material adheres to the inner circumferential surface 50*i* of the metal shell 50 from a state where such a foreign material does not adhere to the inner circumferential surface 50*i* of the metal shell 50, thus whether or not the inner circumferential surface 50*i* of the metal shell 50 has a predetermined form can be appropriately determined.

As described with reference to FIGS. 6 and 7, the processing of determining whether or not the inner circumferential surface 50*i* of the metal shell 50 has a predetermined form includes the following processing. For each of N discharge images, K (K is an integer greater than or equal to 2) partial areas radially equiangularly divided around the axis CL at the center are identified (S320). K same-direction partial area groups, each of which is a same-direction partial area group including N partial areas positioned in the same direction with reference to the axis CL and which have different orientations with reference to the axis CL, are identified using N×K partial areas obtained from the N discharge images (S330). For each same-direction partial area group, a discharge ratio RT, which is the ratio of the number of images indicating discharge crossing the partial areas included in the same-direction partial area group to the total number N of discharge images, is calculated (S340). The condition C2 is that the high area ratio TRT exceeds a threshold value greater than the even ratio, the high area ratio TRT being the total of L discharge ratios RT of circumferentially contiguous L ($1 \leq L < K$) same-direction partial area groups with the center at a same-direction partial area group having the highest discharge ratio RT, the even ratio being the total of L discharge ratios of L same-direction partial area groups when N discharge occurrences are evenly distributed in the circumferential direction. Consequently, it is possible to distinguish a state where the positions of discharge in the circumferential direction is are unevenly located in a partial range in the circumferential direction from another state, and thus whether or not the inner circumferential surface 50*i* of the metal shell 50 has a predetermined form can be appropriately determined.

Also, in addition to the form of the inner circumferential surface 50*i* of the metal shell 50 (FIG. 1), the condition C2 for the determination processing in the second embodiment can determine whether or not the form of a member (here, an inspection body) obtained by mounting the metal shell 50 on the assembly body 110 is a predetermined form (in other words, an appropriate form). For instance, when the central axis of the center electrode 20 deviates from the central axis of the metal shell 50, discharge concentrates in a direction deviating from the central axis of the center electrode 20 in the entire circumferential range. The presence of such a defect can be determined by the condition C2. Also, the packing 8 between the outer diameter reduction portion 16 of the insulator 10 and the projection portion 56 of the metal shell 50 can be crushed by mounting the metal shell 50 on the insulator 10. A crushed portion of the packing 8 may stick out from the outer diameter reduction portion 16 of the insulator 10 in the front direction Df. When the portion sticking out is large, discharge may occur between the portion sticking out and the center electrode 20. In the circumferential entire range, the discharge concentrates in the direction of the portion sticking out in the packing 8. The presence of such a defect can be determined by the condition C2.

C. Third Embodiment

Figure 8:
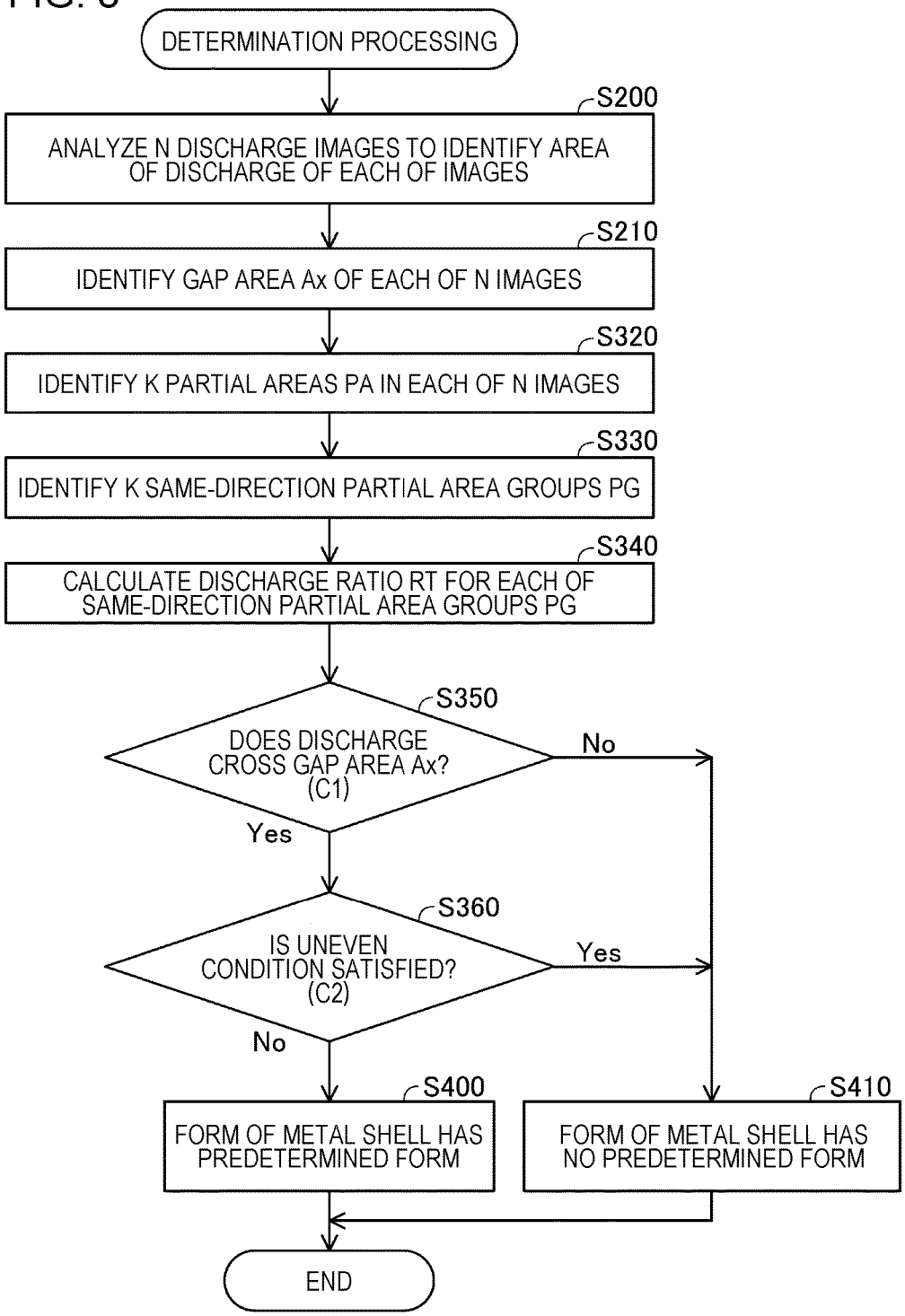
FIG. 8 is a flowchart illustrating a third embodiment of the determination processing.

FIG. 8 is a flowchart illustrating a third embodiment of the determination processing (S130) of FIG. 2. In this embodiment, both of the condition C1 of S350 in FIG. 5 and the condition C2 of S360 in FIG. 6 are used. The processing other than S130 in the manufacturing method is the same as corresponding processing in the first embodiment of FIG. 2. The program 832 of the processing device 800 (FIG. 3) is configured so as to execute the processing in the third embodiment.

In this embodiment, the processor 810 (FIG. 3) executes S200, S210, S320, S330, and S340. The processing in S200 and S210 is the same as the processing in S200 and S210, respectively of FIG. 5. The processing in S320, S330, and S340 is the same as the processing in S320, S330, and S340, respectively of FIG. 6.

In S350, similarly to S350 of FIG. 5, the processor 810 determines whether or not the condition C1 is satisfied. When the condition C1 is satisfied (Yes in S350), similarly to S360 of FIG. 6, the processor 810 determines in S360 whether or not the condition C2 is satisfied. When the condition C2 is not satisfied (No in S360), the processor 810 determines in S400 that the form of the metal shell is a predetermined form. The processing in S400 is the same as the processing in S400 of FIG. 5. The processor 810 then completes the processing of FIG. 8.

When the condition C1 is not satisfied (No in S350) or when the condition C2 is satisfied (Yes in S360), the processor 810 determines in S410 that the form of the metal shell is not a predetermined form. The processing in S410 is the same as the processing in S410 of FIG. 5. The processor 810 then completes the processing of FIG. 8.

As described above, in this embodiment, the conditions for determining that the form of the inner circumferential surface 50*i* of the metal shell 50 is a predetermined form are that the cross condition C1 is satisfied and the uneven condition C2 is not satisfied. Since a logical AND with the two conditions C1, C2 is used in this manner, occurrence of manufacturing the spark plug 100 using an inappropriate metal shell can be reduced.

D. Fourth Embodiment

Figure 9:
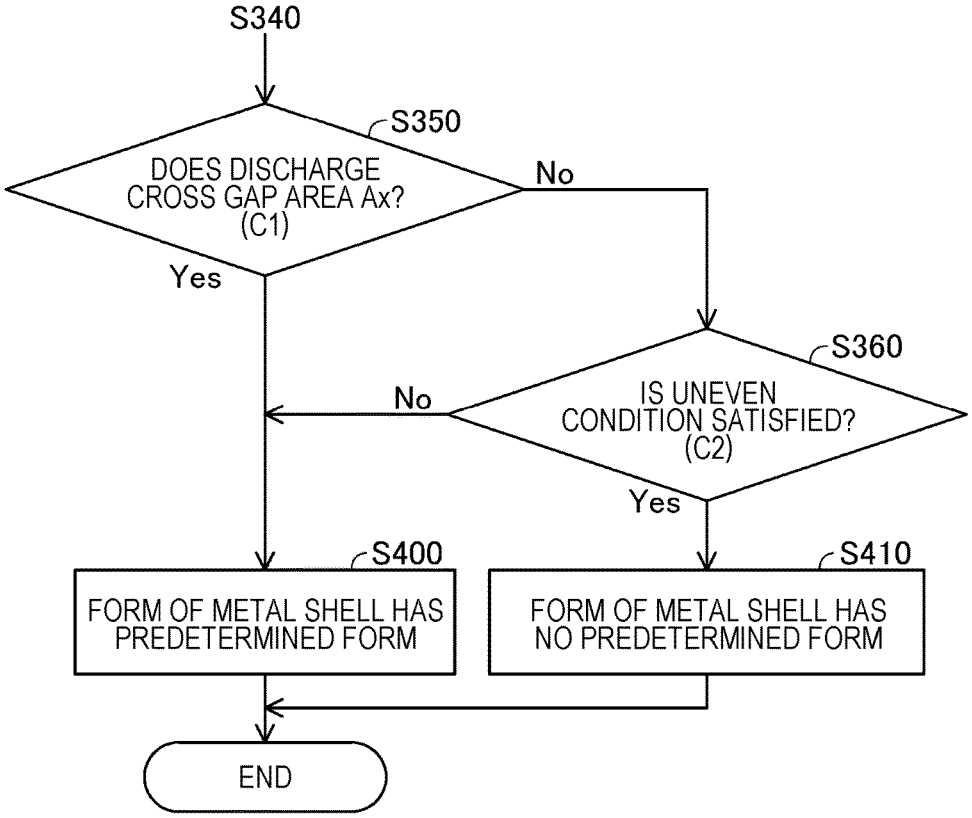
FIG. 9 is a flowchart illustrating a fourth embodiment of the determination processing.

FIG. 9 is a flowchart illustrating a fourth embodiment of the determination processing (S130) of FIG. 2. The fourth embodiment differs from the third embodiment of FIG. 8 in that the processing following S340 is replaced by the processing of FIG. 9. The processing other than S130 in the manufacturing method is the same as corresponding processing in the first embodiment of FIG. 2. The program 832 of the processing device 800 (FIG. 3) is configured so as to execute the processing in the fourth embodiment.

In S350 after S340, similarly to S350 of FIG. 5, the processor 810 determines whether or not the condition C1 is satisfied. When the condition C1 is satisfied (Yes in S350), the processor 810 determines in S400 that the form of the metal shell is a predetermined form. The processing in S400 is the same as the processing in S400 of FIG. 5. The processor 810 then completes the processing of FIG. 9.

When the condition C1 is not satisfied (No in S350), similarly to S360 of FIG. 6, the processor 810 determines in S360 whether or not the condition C2 is satisfied. When the condition C2 is not satisfied (No in S360), the processor 810 determines in S400 that the form of the metal shell is a predetermined form. The processor 810 then completes the processing of FIG. 9.

When the condition C1 is not satisfied (No in S350) and the condition C2 is satisfied (Yes in S360), the processor 810 determines in S410 that the form of the metal shell is not a predetermined form. The processing in S410 is the same as the processing in S410 of FIG. 5. The processor 810 then completes the processing of FIG. 9.

As described above, in this embodiment, the conditions for determining that the form of the inner circumferential surface 50*i* of the metal shell 50 is a predetermined form are that the condition C is satisfied or the uneven condition C2 is not satisfied. Since a logical OR with the two conditions C1, C2 is used in this manner, erroneous determination such that an appropriate form of the inner circumferential surface 50*i* of the metal shell 50 is determined to be not a predetermined form is reduced, and the spark plug 100 can be manufactured using an appropriate metal shell.

E. Modification (1) The insulator utilized for inspection of the metal shell 50 may be a different member from the insulator 10 of a completed spark plug 100. As illustrated in FIGS. 3 and 4, the portion of the insulator 10, which affects the discharge for inspection is the front end portion 10*f* on the front direction Df side of the insulator 10. Specifically, the portion 10*f* forming an exposed portion of the outer circumferential surface 10*o*, that is, the portion 10*f* forming the annular space Sg affects the discharge for inspection (here, the outer diameter reduction portion 16 and the leg portion 19). Thus, various members having a front end portion in the same shape as the shape of at least the front end portion 10*f* (the portion forming the exposed outer circumferential surface 10*o*) of the insulator 10 of the spark plug 100 may be used as the insulator for inspection. For instance, the insulator for inspection may be the portion (that is, the portion on the front end side) of the insulator 10 of FIG. 1, which remains after the portion on the rear direction Dfr side of the front end trunk portion 15 is removed. When an insulator for inspection different from the insulator 10 is used for inspection, the insulator for inspection is removed from the inspection body after completion of the inspection. When the spark plug 100 is assembled, the insulator 10 for assembly is mounted on the metal shell 50.

Also, the center electrode utilized for inspection of the metal shell 50 may be a different member from the center electrode 20 of a completed spark plug 100. As illustrated in FIGS. 3 and 4, the portion of the center electrode 20, which affects the discharge for inspection is the front end portion 20*f* on the front direction Df side of the center electrode 20. Specifically, the portion 20*f* exposed to the front direction Df side of the axial bore 12 of the insulator 10 affects the discharge for inspection. Thus, various members having a front end portion in the same shape as the shape of at least the front end portion 20*f* (the exposed portion on the front direction Df side of the axial bore 12 of the insulator 10) of the center electrode 20 of the spark plug 100 may be used as the center electrode for inspection. For instance, the center electrode for inspection may be the portion (that is, the portion on the front end side) of the center electrode 20 of FIG. 1, which remains after the portion positioned in the axial bore 12 of the insulator 10 is removed. When a center electrode for inspection different from the center electrode 20 is used for inspection, the center electrode for inspection is removed from the inspection body after completion of the inspection. When the spark plug 100 is assembled, the center electrode 20 for assembly is mounted on the insulator 10.

The assembly body used for inspection may be a dummy assembly body which includes a temporary insulator and a temporary center electrode, not necessarily the same members as in the assembly body 110 of a completed spark plug 100. In either case, an assembly body obtained by mounting multiple members in the same positions as those of corresponding members in a completed spark plug 100 may be used as an assembly body for inspection, the multiple members including a temporary insulator having a front end portion in the same shape as the shape of at least the front end portion 10*f* of the insulator 10, and a temporary center electrode having a front end portion in the same shape as the shape of at least the front end portion 20*f* of the center electrode 20. A member obtained by mounting the metal shell 50 on an assembly body for inspection may be used as an inspection body to which a voltage for discharge is applied.

(2) The cross condition C1 (S350 in FIGS. 5, 8, and 9) is not limited to the above-described condition, and may be one of various conditions that are satisfied when a foreign material does not adhere to the inner circumferential surface 50*i* of the metal shell 50, and discharge can cross the gap area Ax freely on a discharge image. For instance, when determination is made using P (P is an integer greater than or equal to 1) discharge images, the cross condition C1 may be that discharge cross the gap area Ax on Q (Q is an integer between 1 and P inclusive) discharge images among P discharge images. Here, in order to reduce erroneous determination that the form of the inner circumferential surface 50*i* of the metal shell 50 is a predetermined form even though a foreign material adheres to the inner circumferential surface 50*i*, it is preferable that Q be large, and it is the most preferable that Q be the same as P.

Also, the uneven condition C2 (S360 in FIGS. 6, 8, and 9) is not limited to the above-described condition, and may be one of various conditions that are satisfied when the positions of discharge in the circumferential direction are unevenly located in a partial range in the circumferential direction. For instance, the uneven condition C2 may be that the difference between the maximum value and the minimum value of the K discharge ratios RT of the K same-direction partial area groups PG is greater than or equal to a predetermined threshold value. In either case, it is preferable to use at least two discharge images to determine whether or not the uneven condition C2 is satisfied.

Also, the conditions for determining that the form of the inner circumferential surface 50*i* of the metal shell 50 is a predetermined form are not limited to the conditions in FIGS. 5, 6, 8, and 9, and may be other various conditions. In general, it is preferable to use a condition including at least one of the condition that the cross condition C1 is satisfied and the condition that the uneven condition C2 is not satisfied.

(3) The total number P of discharge images used for inspection may be any number greater than or equal to 1. For instance, the cross condition C1 (S350 in FIGS. 5, 8, and 9) may be determined based on one discharge image. It is to be noted that in order to conduct appropriate inspection, it is preferable that the total number P be greater than or equal to 2, and it is particularly preferable that the total number P be greater than or equal to 100. Like the uneven condition C2 described with reference to FIG. 7, when K (K is an integer greater than or equal to 2) partial areas are used for determination, it is preferable that the total number P be greater than K.

(4) Instead of the configurations of the embodiments, any of other various configurations may be used as the configuration of the spark plug. For instance, the packing 8 (FIG. 1) on the front end side may be omitted. In this case, the projection portion 56 of the metal shell directly supports the outer diameter reduction portion 16 of the insulator. Also, instead of the front end surface (for instance, the surface, on the front direction Df side, of the first tip 29 of FIG. 1) of the front end portion 20*f* of the center electrode, the lateral surface (the surface normal to the direction perpendicular to the axis CL) of the front end portion 20*f* of the center electrode, and the ground electrode may form a gap for discharge. The total number of gaps for discharge may be greater than or equal to 2. The resistive element 73 may be omitted. A magnetic substance may be disposed between the center electrode in a through hole of the insulator and the metal terminal. Also, the ground electrode 30 may be omitted. In this case, discharge may occur between the center electrode 20 of the spark plug and another member in a combustion chamber.

(5) Instead of the methods of the embodiments, the method of manufacturing a spark plug may be any of other various methods. For instance, an inspection body may be prepared by mounting all the members of a spark plug. In this case, in a step of assembling a spark plug after inspection, only the discharge gap g may be adjusted.

(6) The processing device 800 of FIG. 3 may be a device of a type different from a personal computer. For instance, the processing device 800 may be incorporated in the power supply device 900. Also, multiple devices (for instance, computers) capable of communicating with each other via a network may each partially share the function of data processing performed by the processing device, and may provide the function of the processing device as a whole (a system including these devices corresponds to the processing device).

In the embodiments, part of the configuration implemented by hardware may be replaced by software, or conversely, part or all of the configuration implemented by software may be replaced by hardware. For instance, the function in S200 of FIG. 5 may be implemented by a dedicated hardware circuit.

When part or all of the function of the present invention is implemented by a computer program, the program may be provided in the form that the program is stored in a computer-readable recording medium (for instance, a non-volatile recording medium). The program may be used with stored in a recording medium (computer-readable recording medium) which is the same as or different from a recording medium when the program is provided. The "computer-readable recording medium" is not limited to a portable recording medium, such as a memory card or a CD-ROM, and includes an internal memory device in a computer, such as various types of ROM, and an external memory device connected to a computer, such as a hard disk drive.

Although the present invention has been described above based on the embodiments and modifications, the above-described embodiments of the invention are provided to facilitate the understanding of the invention, and are not intended to limit the invention. The invention may be modified or improved without departing from the spirit and scope of the invention, and may include its equivalents.

Having described the invention, the following is claimed:

1. A method of manufacturing a spark plug including:

a cylindrical insulator having an axial bore extending in a direction of an axis, a metal shell disposed around an outer circumference of the insulator, and a center electrode that is disposed in the axial bore of the insulator, and that has a front end portion projecting from a front end of the insulator, annular space having an opening on a front end side, being present between an outer circumferential surface of a front end portion of the insulator and an inner circumferential surface of the metal shell, the method comprising:

mounting the metal shell on an assembly body of a temporary insulator with a front end portion having a same shape as a shape of at least the front end portion of the insulator, and a temporary center electrode with a front end portion having a same shape as a shape of at least the front end portion of the center electrode;

causing discharge to occur between the temporary center electrode and the metal shell by applying a voltage across the metal shell and the temporary center electrode under an atmosphere of a predetermined pressure condition, and capturing, while the discharge is occurring, an image of a range including the temporary center electrode, the temporary insulator, annular space which is present between the temporary insulator and the metal shell and has an opening on the front end side, and the metal shell from the front end side in the direction of the axis;

determining whether or not a form of the inner circumferential surface of the metal shell is a predetermined form by analyzing the image obtained in the capturing; and assembling the spark plug using the metal shell, when the form of the inner circumferential surface of the metal shell is determined to be the predetermined form.

2. The method of manufacturing a spark plug according to claim 1, wherein in the assembling, the spark plug is assembled by using the temporary insulator and the temporary center electrode as the insulator and the center electrode.

3. The method of manufacturing a spark plug according to claim 1, wherein the spark plug includes a ground electrode that is connected to the metal shell and faces the center electrode, and in the capturing, the discharge is caused to occur before the ground electrode is disposed at a position facing the temporary center electrode.

4. The method of manufacturing a spark plug according to claim 1, wherein the metal shell includes a projection portion that projects inwardly in a radial direction, the temporary insulator is directly or indirectly supported by the projection portion from the front end side, and the determining includes determining whether or not the discharge crosses an area indicating a gap between the temporary insulator and the projection portion of the metal shell on the image.

5. The method of manufacturing a spark plug according to claim 1, wherein the capturing is performed N times, wherein N is an integer greater than or equal to 2, and the determining includes determining whether or not an uneven condition is satisfied, the uneven condition indicating that positions of discharge in a circumferential direction around the axis at a center in N images obtained in the capturing are unevenly located in a partial range in the circumferential direction.

6. The method of manufacturing a spark plug according to claim 5, wherein the determining includes:

identifying K, wherein K is an integer greater than or equal to 2 partial areas radially equiangularly divided around the axis at the center for each of the N images;

identifying K same-direction partial area groups, each of which is a same-direction partial area group including N partial areas positioned in a same orientation with reference to the axis and which have different orientations with reference to the axis, by using N×K partial areas obtained from the N images; and calculating, for each of the same-direction partial area groups, a ratio of a number of images indicating discharge crossing the partial areas included in the same-direction partial area group to the total N images, and the uneven condition is that a total of L ratios each of which is the ratio of circumferentially contiguous L, wherein $1 \leq L \leq K$ same-direction partial area groups with a center at the same-direction partial area group having the ratio of a highest exceeds a threshold value greater than a total of the L ratios of the L same-direction partial area groups when N discharge occurrences are evenly distributed in the circumferential direction.

* * * * *